US009117432B2

(12) United States Patent
Nakamura

(10) Patent No.: US 9,117,432 B2
(45) Date of Patent: Aug. 25, 2015

(54) APPARATUS AND METHOD FOR DETECTING CHORD

(71) Applicant: YAMAHA CORPORATION, Hamamatsu-shi, Shizuoka-ken (JP)

(72) Inventor: Yoshinari Nakamura, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/191,803

(22) Filed: Feb. 27, 2014

(65) Prior Publication Data

US 2014/0238220 A1 Aug. 28, 2014

(30) Foreign Application Priority Data

Feb. 27, 2013 (JP) ..... 2013-36869

(51) Int. Cl.
*G10H 1/38* (2006.01)

(52) U.S. Cl.
CPC ..... *G10H 1/383* (2013.01); *G10H 1/38* (2013.01); *G10H 2210/056* (2013.01); *G10H 2210/066* (2013.01); *G10H 2210/081* (2013.01); *G10H 2210/571* (2013.01); *G10H 2210/576* (2013.01)

(58) Field of Classification Search
USPC ..... 84/613, 637, 669
IPC ..... G10H 1/38,1/383, 2210/056, 2210/571, G10H 2210/576
See application file for complete search history.

(56) References Cited

U.S. PATENT DOCUMENTS 5,850,051 A * 12/1998 Machover et al. ..... 84/634
5,852,252 A * 12/1998 Takano ..... 84/650
5,918,303 A 6/1999 Yamaura et al.
7,470,853 B2 * 12/2008 Yamane ..... 84/616
8,013,229 B2 * 9/2011 Xu ..... 84/609
8,168,877 B1 * 5/2012 Rutledge et al. ..... 84/613
8,338,686 B2 * 12/2012 Mann et al. ..... 84/609
8,492,634 B2 * 7/2013 Savo et al. ..... 84/610
8,566,258 B2 * 10/2013 Pachet et al. ..... 706/12
8,706,274 B2 * 4/2014 Kobayashi ..... 700/94
8,779,268 B2 * 7/2014 Serletic et al. ..... 84/609
8,785,760 B2 * 7/2014 Serletic et al. ..... 84/625
2007/0157795 A1 * 7/2007 Hung ..... 84/600
2007/0289434 A1 * 12/2007 Yamada et al. ..... 84/613
2008/0058101 A1 * 3/2008 Hato ..... 463/35

(Continued)

FOREIGN PATENT DOCUMENTS

JP 3821094 B2 9/2006
JP 2012-098480 A 5/2012
JP 2012098480 A 5/2012

OTHER PUBLICATIONS

Extended European Search Report for corresponding EP14155881.7, mail date May 19, 2014.

(Continued)

*Primary Examiner* — David Warren
(74) *Attorney, Agent, or Firm* — Rossi, Kimms & McDowell LLP

(57) ABSTRACT

A chord detection apparatus retrieves musical performance data indicative of musical performance played by a user, retrieves musical piece information indicative of a musical piece played by the user, retrieves chord tendency information indicative of degrees of likelihood or unlikelihood of chords appearing in the musical piece, and detects a chord on the basis of the retrieved musical performance data and the retrieved chord tendency information.

19 Claims, 12 Drawing Sheets

(56) References Cited

U.S. PATENT DOCUMENTS

| | | | | |
|---|---|---|---|---|
| 2008/0092722 | A1* | 4/2008 | Kobayashi | 84/661 |
| 2008/0209484 | A1* | 8/2008 | Xu | 725/105 |
| 2008/0245215 | A1* | 10/2008 | Kobayashi | 84/661 |
| 2009/0064851 | A1* | 3/2009 | Morris et al. | 84/637 |
| 2009/0151547 | A1* | 6/2009 | Kobayashi | 84/613 |
| 2009/0287323 | A1* | 11/2009 | Kobayashi | 700/94 |
| 2010/0126332 | A1* | 5/2010 | Kobayashi | 84/613 |
| 2010/0170382 | A1* | 7/2010 | Kobayashi | 84/613 |
| 2010/0186576 | A1* | 7/2010 | Kobayashi | 84/612 |
| 2010/0198760 | A1* | 8/2010 | Maddage et al. | 706/12 |
| 2010/0211200 | A1* | 8/2010 | Kobayashi | 700/94 |
| 2010/0246842 | A1* | 9/2010 | Kobayashi | 381/61 |
| 2010/0305732 | A1* | 12/2010 | Serletic | 700/94 |
| 2010/0307321 | A1* | 12/2010 | Mann et al. | 84/613 |
| 2010/0319517 | A1* | 12/2010 | Savo et al. | 84/609 |
| 2010/0322042 | A1* | 12/2010 | Serletic et al. | 369/1 |
| 2011/0010321 | A1* | 1/2011 | Pachet et al. | 706/12 |
| 2012/0125179 | A1* | 5/2012 | Kobayashi | 84/611 |
| 2012/0297958 | A1* | 11/2012 | Rassool et al. | 84/609 |
| 2012/0297959 | A1* | 11/2012 | Serletic et al. | 84/626 |
| 2013/0025437 | A1* | 1/2013 | Serletic et al. | 84/634 |
| 2013/0112065 | A1* | 5/2013 | Rutledge et al. | 84/603 |
| 2013/0220102 | A1* | 8/2013 | Savo et al. | 84/609 |
| 2014/0053710 | A1* | 2/2014 | Serletic et al. | 84/609 |
| 2014/0053711 | A1* | 2/2014 | Serletic et al. | 84/611 |
| 2014/0140536 | A1* | 5/2014 | Serletic et al. | 381/98 |
| 2014/0229831 | A1* | 8/2014 | Chordia et al. | 715/717 |
| 2014/0238220 | A1* | 8/2014 | Nakamura | 84/613 |
| 2014/0297012 | A1* | 10/2014 | Kobayashi | 700/94 |
| 2014/0330900 | A1* | 11/2014 | Libin et al. | 709/204 |

OTHER PUBLICATIONS

Simon Dixon, et al., "Probalistic and Logic-Based Modelling of Harmony"; Exploring Music Contents, Jun. 21, 2010, pp. 1-9.

Ana M. Barbancho, et al.; "Automatic Transcription of Guitar Chords and Fingering From Audio"; IEEE Transaction on Audio, Speech and Language Processing, vol. 20, No. 3, Mar. 2, 2012. pp. 915-921.

* cited by examiner

FIG.3

| degree name | diatonic | function | Prior | chord constituent notes | | | | | tension note | other (avoid note, etc.) |
|---|---|---|---|---|---|---|---|---|---|---|
| | | | | root | third | fifth | fourth note | altered | | |
| IMaj7 | ○ | T | 29 | 50 | 40 | 25 | 30 | 0 | 3 | -20 |
| Iadd9 | ○ | T | 29 | 53 | 40 | 30 | -33 | 0 | 37 | -20 |
| IIm7 | ○ | S | 25 | 52 | 43 | 25 | 20 | 0 | 2 | -20 |
| IVMaj7 | ○ | S | 29 | 50 | 40 | 25 | 30 | 0 | 3 | -20 |
| V7 | ○ | D | 29 | 50 | 40 | 15 | 39 | 0 | 2 | -20 |
| VIIm7(♭5) | ○ | D | 16 | 50 | 40 | 0 | 20 | 35 | 5 | -20 |
| IVm6 | × | SM | 14 | 50 | 40 | 25 | 20 | 0 | 5 | -20 |
| ⋮ | ⋮ | ⋮ | ⋮ | | | | | | | |

APPARATUS AND METHOD FOR DETECTING CHORD

BACKGROUND OF THE INVENTION

1. Field of the Invention

The present invention relates to an apparatus and method for detecting chords real-time to fit retrieved musical performance data.

2. Description of the Related Art

Conventionally, there are chord detection apparatuses for detecting chords real-time to fit retrieved musical performance data. Such conventional chord detection apparatuses include an apparatus which detects a suitable chord from input musical performance data by procedures A to F which will be described below (see Japanese Unexamined Patent Publication No. 2012-98480, for example).

A: retrieving musical performance data (note events) falling within certain chord detection timing (a certain period of time) from input musical performance data;

B: extracting candidate chords by a set extraction manner on the basis of the retrieved musical performance data and retrieved key information;

C: identifying roles of respective notes (note events) in each extracted candidate chord;

D: figuring out musical points (importance) of each note by referring to a degree name point table (FIG. 3 which will be described later) on the basis of its identified role;

E: summing up the respective amounts of points of the notes of each candidate chord extracted by the procedure "B", the respective amounts of points being obtained by the procedure "D"; and F: detecting a candidate chord gaining the highest total amount of points at the procedure "E" as a suitable chord.

Furthermore, there is also a musical performance setting data selection apparatus which allows a user to select a title of a musical piece that the user desires to play, to automatically set musical performance setting data suitable for musical performance of the selected musical piece (see Japanese Patent Publication No. 3821094, for example). As for the conventional musical performance setting data selection apparatus, more specifically, the musical performance setting data which is to be set includes accompaniment style data, melody tone color, and tempo, while sets of musical performance setting data corresponding to titles of musical pieces, respectively, are previously stored in a table. If the user selects a title of a musical piece, the musical performance setting data selection apparatus refers to the table on the basis of the selected title to retrieve corresponding musical performance setting data to set the retrieved musical performance setting data.

SUMMARY OF THE INVENTION

As for the above-described conventional chord detection apparatus, however, in a case where the retrieved musical performance data includes a root of a candidate chord, a user's intended chord can be detected easily by use of a note point table (a table included in the degree name point table) in which the root is given higher points at the procedure "B". Depending on musical piece, or due to musical performance with both hands, however, musical performance data including the root of the user's intended chord is not necessarily retrieved in the chord detection timing. In such a case, there is a possibility that a chord having images different from the musical piece is detected.

The degree name point table which the conventional chord detection apparatus uses includes a priority point table for obtaining priority points of respective chords themselves. By adjusting values of the priority point table, therefore, it is not impossible to give higher priority to specific chords to detect such chords. However, since the adjustment of the priority point table is done for the specific chords (a musical piece), the adjustment of the priority point table only makes it easy to detect the specific chords to which higher priority is given to gain higher points, failing to detect chords which suit the image of the musical piece.

As for the conventional musical performance setting data selection apparatus, furthermore, in response to user's selection of a title of a musical piece, musical performance setting data corresponding to the title is automatically set on the apparatus. However, the set musical performance setting data includes accompaniment style data, melody tone color, tempo and the like, but does not include chord information. By the conventional musical performance setting data selection apparatus, more specifically, chords are treated not as musical performance setting data but as musical performance data. Therefore, the conventional musical performance setting data selection apparatus can set accompaniment style data, melody tone color, tempo and the like which suit the musical piece selected by the user, but cannot set chord progression that suits the image of the musical piece.

The present invention was accomplished to solve the above-described problems, and an object thereof is to provide a chord detection apparatus which can detect chords that are in harmony with retrieved musical performance data, and suit the image of a musical piece. As for descriptions about respective constituent features of the present invention, furthermore, reference letters of corresponding components of an embodiment described later are provided in parentheses to facilitate the understanding of the present invention. However, it should not be understood that the constituent features of the present invention are limited to the corresponding components indicated by the reference letters of the embodiment.

In order to achieve the above-described object, it is a constitutional feature of the present invention to provide a chord detection apparatus including a musical performance data retrieval portion (S15) for retrieving musical performance data indicative of musical performance played by a user; a musical piece information retrieval portion (S2) for retrieving musical piece information indicative of a musical piece played by the user; a chord tendency information retrieval portion (S3) for retrieving chord tendency information indicative of degrees of likelihood or unlikelihood of chords appearing in the musical piece; and a chord detection portion (S17 to S21) for detecting a chord on the basis of the musical performance data retrieved by the musical performance data retrieval portion and the chord tendency information retrieved by the chord tendency information retrieval portion.

In this case, the musical performance data retrieval portion retrieves musical performance data played by a user during a predetermined period or in predetermined timing, for example (S51 to S56). The chord tendency information represents the degrees of likelihood or unlikelihood of chords so as to be associated with at least one element of chord name, scale degree of chord root, chord type and chord function, for example (FIG. 4(*c*)). The chord tendency information retrieval portion retrieves chord tendency information corresponding to the musical piece by reading out chord tendency information previously stored such that the chord tendency information is associated with the musical piece, for example (S31, S33, S42). Furthermore, the chord tendency information retrieval portion retrieves chord tendency information corresponding to the musical piece by analyzing chord information or musical performance information previously stored so as to be associated with the musical piece, for example (S34 to S40, S42).

Furthermore, the chord detection portion includes a candidate extraction portion (S17 to S20) for extracting a plurality of candidate chords; and a first reflection portion (S72) for reflecting the chord tendency information retrieved by the chord tendency retrieval portion in the respective candidate chords extracted by the candidate extraction portion; and the chord detection portion detects one of the candidate chords in which the chord tendency information has been reflected by the first reflection portion (S75), for example. The candidate extraction portion extracts candidate chords in accordance with a key of the musical piece, for example. In this case, the key of the musical piece is input by the user (R1a), or retrieved by analyzing the musical performance data retrieved by the musical performance data retrieval portion (R1b). As the candidate chords, furthermore, the candidate extraction portion extracts only diatonic chords of the input or retrieved key (R2a), all chords which can be used in the input or retrieved key (R2b), or chords which can be used in the input or retrieved key and each of which has one or more notes included in the musical performance data (R2c).

According to the present invention configured as above, in response to user's musical performance, the chord detection apparatus retrieves musical performance data corresponding to the user's musical performance and chord tendency information corresponding to the musical piece played by the user to detect chords which suit the image of the musical piece in accordance with the retrieved musical performance data and chord tendency information. Resultantly, the chord detection apparatus of the present invention eliminates user's effort to enable user's intended chord detection such as an effort to include a root of a chord in notes that the user plays without fail. Therefore, the chord detection apparatus allows the user to focus on playing the musical piece.

Furthermore, the chord detection apparatus will not rigidly fix chord progression by, for example, sequentially reading out chords in accordance with chord progression previously stored for a user's selected musical piece, but only facilitates detection of chords which suit the image and notes (musical performance data) of the selected musical piece. Therefore, even if the user arranges the musical piece as the user desires during the user's musical performance, or adds or omits a repeat as the user desires, the chord detection apparatus can always achieve the chord detection which suits the image and the notes of the musical piece. Resultantly, the chord detection apparatus enables a wide variety of musical performances with various arranges, also keeping the image of the musical piece.

In a case where there is previously stored chord tendency information corresponding to a designated musical piece, the chord detection apparatus of the present invention can easily read out and use the chord tendency information. In a case where there is no previously stored chord tendency information corresponding to the musical piece, however, the chord detection apparatus of the present invention can retrieve the chord tendency information corresponding to the musical piece by analyzing chord information or musical performance information previously stored so as to be associated with the musical piece. In this case as well, therefore, the chord detection apparatus of the present invention can detect chords which suit the image of the musical piece to fit retrieved musical performance data.

It is another feature of the present invention that the chord detection portion further includes a second reflection portion (S66 to S70) for detecting, by use of the musical performance data retrieved by the musical performance data retrieval portion, respective degrees of importance of notes indicated by the musical performance data to each of the candidate chords extracted by the candidate extraction portion, and reflecting the detected degrees of importance in the candidate chords; and the chord detection portion detects one chord from among the candidate chords in which the degrees of importance have been also reflected by the second reflection portion. According to the feature, the respective degrees of importance of the notes indicated by the musical performance data to the candidate chords are also reflected in the candidate chords, so that the chord detection apparatus can detect chords which suit the image of the musical piece more appropriately to fit the retrieved musical performance data.

It is a further feature of the present invention that the chord detection portion further includes a third reflection portion (S71) for reflecting degrees of priority of the candidate chords themselves extracted by the candidate extraction portion in the respective candidate chords; and the chord detection portion detects one chord from among the candidate chords in which the respective degrees of priority of the candidate chords have been also reflected by the third reflection portion. According to the feature, the respective degrees of priority of the candidate chords themselves are also reflected in the candidate chords, so that the chord detection apparatus can detect chords more appropriately to fit the retrieved musical performance data.

The present invention can be embodied not only as the invention of the chord detection apparatus but also as inventions of a method for detecting a chord and a chord detection program.

BRIEF DESCRIPTION OF THE DRAWINGS

FIG. 3 is an example of a degree name point table;

DESCRIPTION OF THE PREFERRED EMBODIMENT

Figure 1:
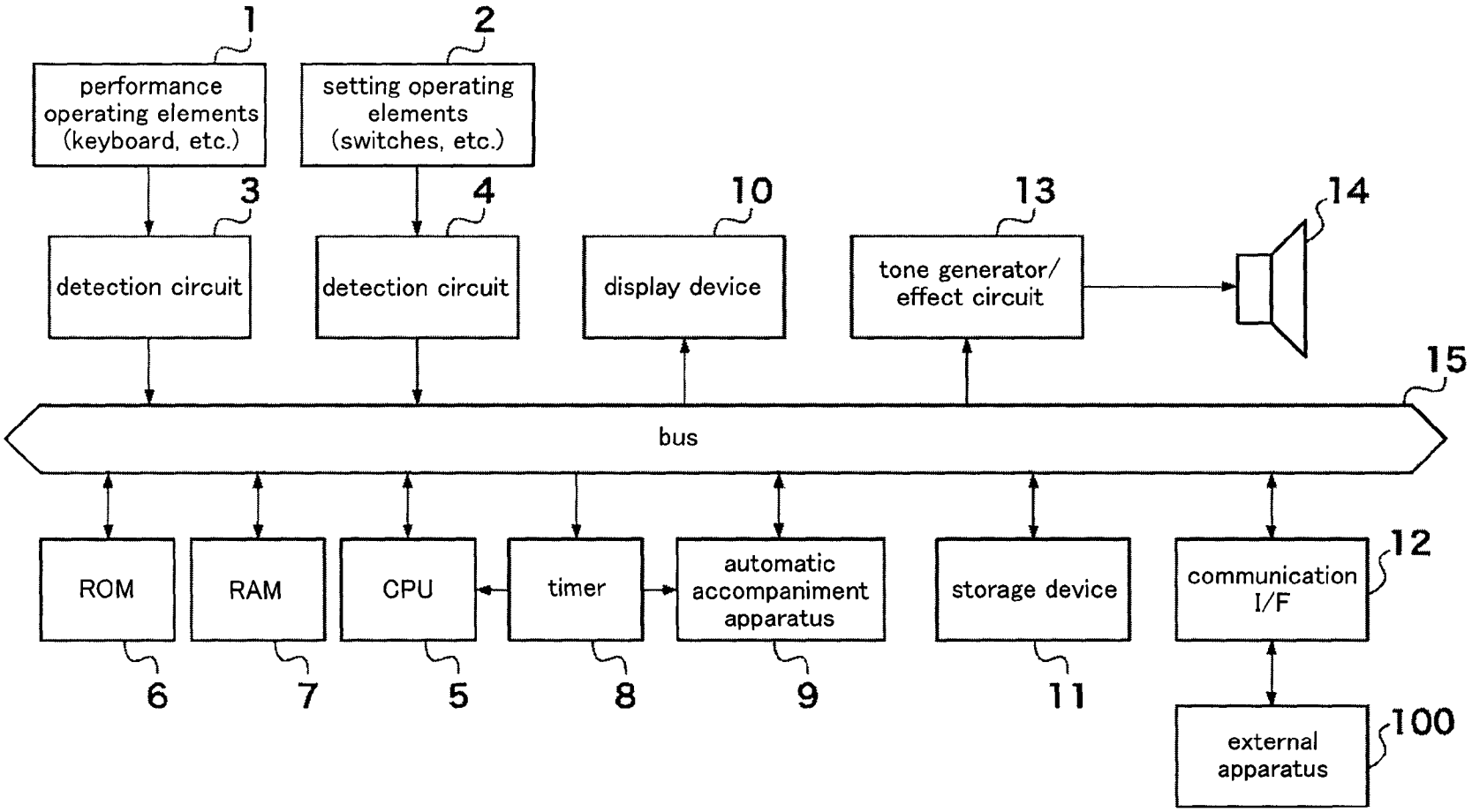
FIG. 1 is a block diagram indicative of a schematic configuration of a chord detection apparatus according to an embodiment of the present invention.

An embodiment of the present invention will now be described with reference to the drawings. FIG. 1 is a block diagram indicative of a schematic configuration of a chord detection apparatus according to an embodiment of the present invention. As indicated in FIG. 1, the chord detection apparatus of the embodiment has performance operating elements 1, setting operating elements 2, a detection circuit 3, a detection circuit 4, a CPU 5, a ROM 6, a RAM 7, a timer 8, an automatic accompaniment apparatus 9, a display device 10, a storage device 11, a communication interface (I/F) 12, a tone generator/effect circuit 13 and a sound system 14.

The performance operating elements 1 include a keyboard for inputting musical performance data including tone pitch information in accordance with user's musical performance operation. The setting operating elements 2 include switches for inputting various kinds of information. The detection circuit 3 detects manipulation of the performance operating elements 1. The detection circuit 4 detects manipulation of the setting operating elements 2. The CPU 5 controls the entire apparatus. The ROM 6 stores control programs which the CPU 5 will execute and various kinds of table data. The RAM 7 temporarily stores musical performance data, various kinds of input information, calculated results, and the like. The timer 8 measures interrupt time for timer interrupts and various kinds of time. The automatic accompaniment apparatus 9 generates musical performance data for generating accompaniment sounds on the basis of chord information supplied from the CPU 5 as described later. The display device 10 has an LCD (liquid crystal display), LEDs (light emitting diodes), and the like for displaying various kinds of information. The communication I/F 12 connects the chord detection apparatus with an external apparatus 100 such as an external MIDI (musical instrument digital interface) apparatus or the like to transmit/receive data to/from the external apparatus 100. The tone generator/effect circuit 13 converts musical performance data input through the performance operating elements 1 and musical performance data generated by the automatic accompaniment apparatus 9 to musical tone signals, and adds various kinds of effects to the musical tone signals. The sound system 14 has a DAC (digital-to-analog converter), for example, which converts musical tone signals supplied from the tone generator/effect circuit 13 to musical sounds. The sound system 14 also has an amplifier, a speaker and the like.

The above-described components 3 to 13 are connected with each other via a bus 15. To the CPU 5 and the automatic accompaniment apparatus 9, the timer 8 is connected. To the communication I/F 12, the external apparatus 100 is connected. To the tone generator/effect circuit 13, the sound system 14 is connected.

The automatic accompaniment apparatus 9, which is realized by making the CPU 5 execute sequencer software previously stored in the ROM 6, for example, generates accompaniment sounds by generating musical performance data on the basis of supplied chord information as described above and supplying the generated musical performance data to the tone generator/effect circuit 13. Furthermore, the automatic accompaniment apparatus 9 has a function of generating musical performance data by reproducing accompaniment style data selected by a user from among various kinds of accompaniment style data previously stored in the ROM 6, for example. When utilizing this function, the automatic accompaniment apparatus 9 reproduces the accompaniment style data on the basis of time information supplied from the timer 8. Since the present invention is not characterized by the configuration and action of the automatic accompaniment apparatus 9, the configuration and the action of the automatic accompaniment apparatus 9 will not be explained any further.

The storage device 11 includes storage media such as flexible disk (FD), hard disk (HD), CD-ROM, DVD (digital versatile disc), magneto-optical disk (MO) and semiconductor memory, and their drives. The storage media may be detachable from the drives. Furthermore, the storage device 11 itself may be detachable from the chord detection apparatus of the embodiment. Alternatively, both the storage media and the storage device 11 may be undetachable. In (the storage media of) the storage device 11, the control programs which will be executed by the CPU 5 can be stored as described above. In a case where the control programs are not stored in the ROM 6, the storage device 11 may store the control programs to allow the RAM 7 to read the control programs to allow the CPU 5 to operate similarly to the case where the control programs are stored in the ROM 6. In that case, resultantly, addition and upgrade of the control programs are facilitated.

To the communication I/F 12, the external apparatus 100 is connected in the shown example. However, the external connection is not limited to the shown example. For instance, a server computer may be connected to the communication I/F 12 via a communication network such as LAN (local area network), Internet, or telephone line. In this case, if the above-described programs and various parameters are not stored in the storage device 11, the communication I/F 12 is used in order to download the programs and parameters from the server computer. The chord detection apparatus serving as a client transmits a command requesting for downloading of the programs and parameters to the server computer via the communication I/F 12 and the communication network. In response to the command, the server computer distributes the requested programs and parameters to the chord detection apparatus through the communication network so that the chord detection apparatus can receive the programs and parameters through the communication I/F 12 to store the received programs and parameters in the storage device 11 to complete the downloading.

The chord detection apparatus of the embodiment is configured on an electronic keyboard musical instrument, as apparent from the above-described configuration. However, the chord detection apparatus may be configured on a general personal computer having an externally connected keyboard. Furthermore, the chord detection apparatus may employ a form of a string instrument type or a wind instrument type, for the present invention can be realized without a keyboard. Furthermore, the present invention can be applied not only to electronic musical instruments but also to electronic apparatuses such as karaoke apparatus, game apparatus and communication apparatus.

The control processing executed by the chord detection apparatus configured as above will be briefly explained with reference to FIG. 2 to FIG. 4, and will be explained in detail with reference to FIG. 5A, FIG. 5B, FIG. 6, FIG. 7, FIG. 8A, FIG. 8B, FIG. 9A and FIG. 9B.

Figure 2:
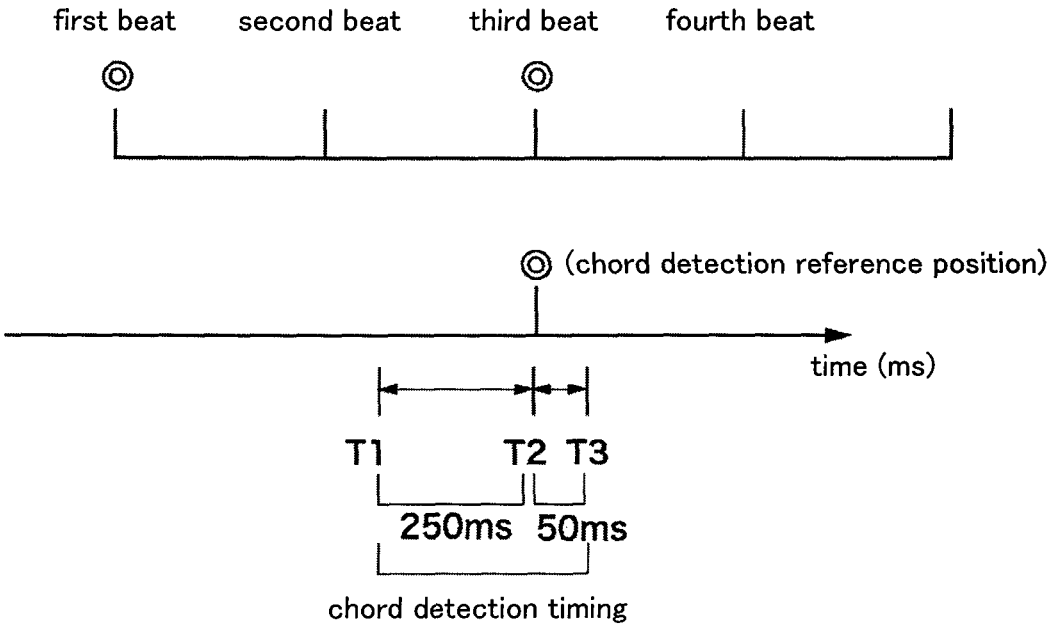
FIG. 2 is an illustration indicative of an example setting of chord detection timing.

FIG. 2 indicates an example setting of chord detection timing. More specifically, FIG. 2 indicates an example in which a musical piece of four-four time is selected as a musical piece to play, with the first beat and the third beat being defined as chord detection reference positions where a period starting 250 ms earlier and ending 50 ms later than each chord detection reference position is defined as chord detection timing. In the shown example, although the chord detection timing is provided on the third beat, the chord detection timing is not provided on the first beat. This is because the chord detection timing of the first beat has the same time period as the chord detection timing of the third beat. Therefore, as long as the chord detection timing is shown for one of the beats in the figure, it is apparent that the other beat also has the similar chord detection timing. As described in detail later, furthermore, the user is allowed to choose the positions of the chord detection timing, the duration of the timing, and the number of the timings (or the frequency of the timings).

In response to user's musical performance by use of the keyboard, the chord detection apparatus of the embodiment directly supplies musical performance data input real-time to the tone generator/effect circuit 13 to generate sounds in accordance with the supplied musical performance data, also detecting chords which suit an image of a played musical piece in accordance with the musical performance data input real-time to supply the detected chords to the automatic accompaniment apparatus 9 to generate accompaniment sounds as well. The period of the chord detection timing (duration) is a period during which musical performance data which is to be referred to for chord detection is supplied to the chord detection apparatus. In other words, only musical performance data supplied during the chord detection timing is referred to for chord detection for generation of accompaniment sounds.

In this embodiment, the chord detection is done by modifying the chord detection processing performed by the conventional chord detection apparatus described in Japanese Unexamined Patent Publication No. 2012-98480 described in Description of the Related Art. More specifically, although the processes A to F described in Description of the Related Art are to be done without any change, a process G which will be described later is to be inserted between the process E and the process F.

Figure 4:
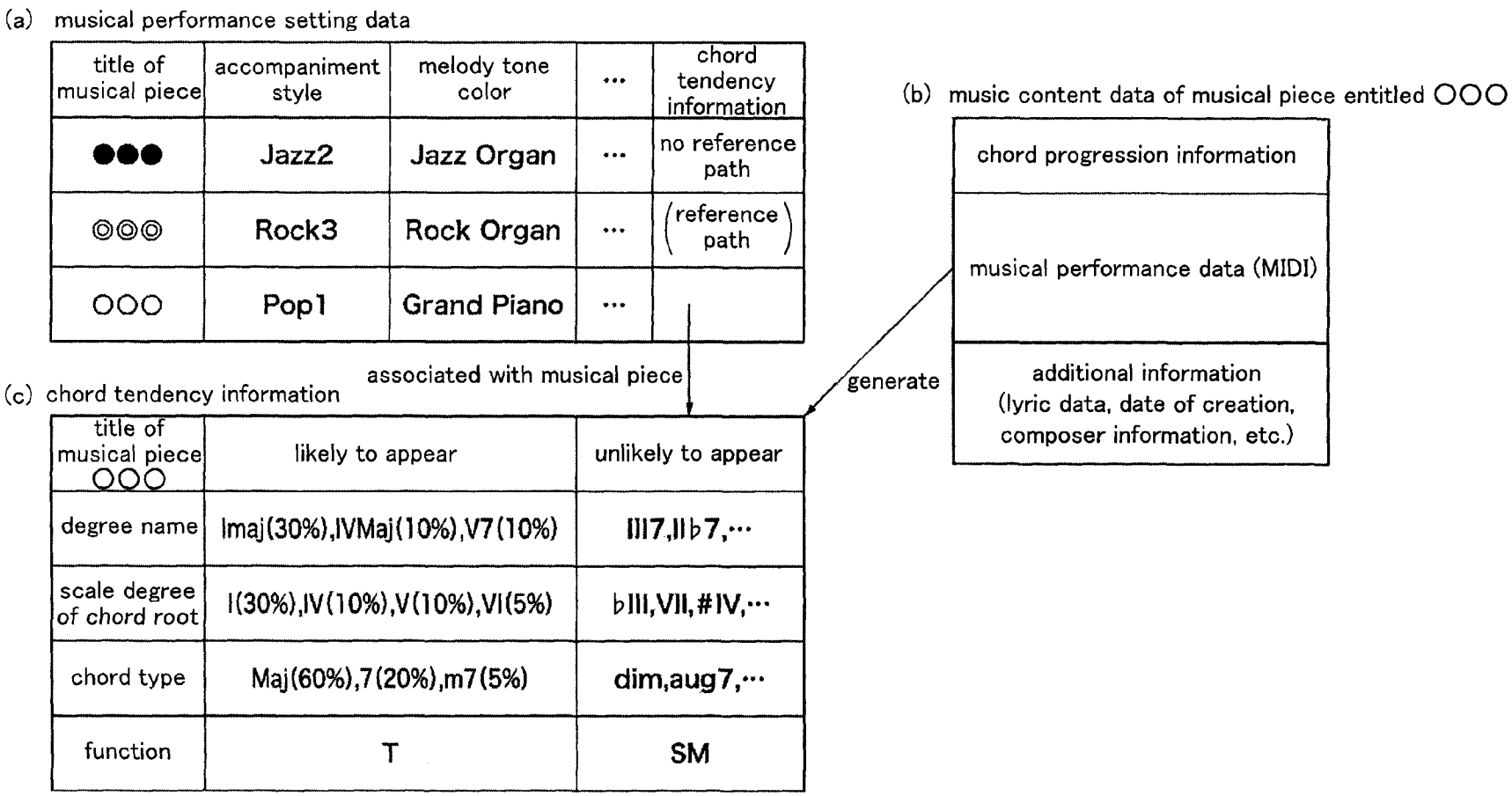
FIG. 4 is examples of musical performance setting data ((a)), musical content data ((b)), and chord tendency information ((c))

FIG. 3 indicates an example of the degree name point table referred to at the process D, while FIG. 4 indicates respective examples of musical performance setting data ((a)), music content data ((b)) and chord tendency information ((c)) used for chord detection.

Although FIG. 3 is identical with FIG. 3 of Japanese Unexamined Patent Publication No. 2012-98480 which is the above-described prior art document, the degree name point table of FIG. 3 will now be explained. What is written in the above-described Japanese Unexamined Patent Publication No. 2012-98480 is incorporated into this specification. The degree name point table includes a note point table (the fifth to eleventh columns) for gaining points of respective notes (root, third, fifth, etc.) of every possible candidate chord, and a priority point table (the fourth column) for gaining priority points (Prior) of each chord itself. The degree name point table is provided for major key and minor key, respectively, and further has pieces of information (the third and second columns) about chord function and about whether a corresponding chord is a diatonic chord or not. Although the degree name point table of FIG. 3 is a table which lists all the possible candidate chords of major keys, a similar table is provided for candidate chords of minor keys as well (not shown).

In the degree name point table of FIG. 3, the first column indicates degree name information (also referred to as chord information, and hereafter simply referred to as degree name). In addition to the shown degree names, the degree name point table includes many degree names. Each degree name indicates a chord by a combination of a scale degree relative to a key tonic (scale degree of a root such as I, II, III, IV, V . . . ) and a chord type (e.g., no symbol (major), m (minor), 7, 6, Maj7 (major7), m6 (minor 6), m7 (minor 7), add9 (major added 9th) . . . ). In the figure, "♭" represents a flat, and this symbol is used similarly in the other examples which will be described later.

The degree name point table is designed such that each degree name indicated in the first column (the first field) has various kinds of information indicated in the second and later columns (the second and later fields). The diatonic information of the second column indicates whether the chord represented by the corresponding degree name is a diatonic chord (○) or not (X). The function information of the third column indicates the function of the corresponding degree name, that is, that the function of the degree name is a tonic (T), a subdominant (S), a dominant (D) or a subdominant minor (SM). The priority point information (Prior) of the fourth column indicates the degree of priority assigned to the corresponding degree name by points. The points are also referred to as chord priority points or degree name priority points. In the degree name point table, the fifth to eleventh columns constitute a note point table portion which defines note point information indicative of the degree of musical importance of each note (a root, a third, a fifth, and so on) which characterizes the corresponding chord.

The note point information indicated in each of the fifth to ninth columns represents the degree of musical importance of the corresponding note (role) of chord constituent notes of the corresponding chord by point value. More specifically, the root point information of the fifth column indicates points given to the root of the chord constituent notes of the corresponding chord. The third point information of the sixth column indicates points given to the third of the chord constituent notes of the corresponding chord. The fifth point information of the seventh column indicates points given to the fifth of the chord constituent notes of the corresponding chord. The fourth note point information of the eighth column indicates points given to the fourth note which is a major sixth (6th), a minor seventh (7th) or a major seventh (Maj 7th) from the root of the chord constituent notes of the corresponding chord. The altered point information of the ninth column indicates points given to an altered fifth (altered chord tone) of a diminished fifth (♭5th) or an augmented fifth (#5th) from the root of the chord constituent notes of the corresponding chord.

The tension note point information of the tenth column indicates the degree of musical importance of a tension note by point value. A tension note is a non-harmonic tone located above basic chord constituent notes of the corresponding chord to add tension. The other point information of the eleventh column (rightmost field) indicates the degree of musical importance of the other notes which are neither the chord constituent notes nor the tension notes such as avoid notes which are excluded from chord sounds. The other point information is also represented by points.

In this note point table portion (the fifth to eleventh columns), notes (notes generated by key-depression or tone pitch information) particularly having the role of a root among chord constituent notes are considered as having higher importance to be given higher points. Among chord constituent notes, in addition, notes of the third or the seventh (the fourth note) which are deeply responsible for chord type determination are also considered as important. However, (the other) notes having a role which is dissonant in chords have lower importance to be given lower points.

By the above-described processes B to E, the chord detection apparatus figures out the total amount of points of each candidate chord (Chord List). More specifically, in accordance with a key (Key) of input musical performance data which is to be subjected to chord detection, candidate chords (Chord List) are extracted (process B). In other words, the candidate chords are registered in Chord List. In the chord detection apparatus, for instance, some combinations of chord types that can be used in a certain key are previously stored, so that the chord detection apparatus can choose a desired combination on chord detection to extract chords corresponding to the chosen combination as candidate chords (Chord List). Since the degree name point table shown in FIG. 3 has not only the point information (the fourth to eleventh columns) but also the additional information such as the diatonic information indicative of whether or not a chord of a degree name (Degree Name: the first column) is a diatonic chord, and the function information indicative of a function of the degree name, the chord detection apparatus can extract candidate chords (Chord List) by referring to the additional information by use of the degree name point table.

For instance, all the chords (Degree Name) that can be identified at that moment as diatonic chord (information of the second column="○") may be extracted as candidate chords. Alternatively, at the second or later chord detections, the function (information of the third column) of a chord detected at the previous detection may be examined so that chords (Degree Name) which can be musically taken to suit the next progression from the previous chord (Chord) such as a tonic (T) being taken next for a dominant (D) will be extracted as candidate chords (Chord List). The additional information may not be included in the degree name point table, but may be separately provided as a reference table.

After the extraction of the candidate chords (Chord List), it is determined what role each of notes (notes generated by key-depression, Notes) included in the target musical performance data (Note List) plays in the extracted candidate chords (Chord List) (process C). In other words, it is determined what role each of notes included in the target musical performance data plays in the candidate chords registered in Chord List. The role of each note is any one of chord constituent notes (a root note, a third note, a fifth note, a fourth note and an altered fifth note), a tension note, or an avoid note. Next, points corresponding to the determined roles (constituent notes, tension note, avoid note) are obtained in accordance with the degree name point table (process D). Then, points (importance) corresponding to all the played notes (Note List) are summed up for each candidate chord (process E).

After the point calculation for each of the extracted candidate chords by the process E, the CPU 5 carries out the following process G:

G: by referring to chord tendency information (FIG. 4(*c*)) of the currently played musical piece (in the shown example, title of musical piece "○○○"), respective amounts of points of the candidate chords are adjusted.

The point adjustment will be explained concretely in detailed explanation of the control processing. In a case where a candidate chord is defined as being "likely to appear", however, the amount of points of the candidate chord is to be adjusted to increase the amount of points. In a case where the candidate chord is defined as being "unlikely to appear", on the other hand, the amount of points of the candidate chord is to be adjusted to decrease the amount of points.

Then, the CPU 5 carries out the chord detection by performing the above-described process F on the point-adjusted candidate chords. More specifically, the CPU 5 chooses a candidate chord having the highest amount of points adjusted at the process G to define the chosen chord as the most suitable chord (Chord) for the target musical performance data.

As indicated in FIG. 4(*a*), the storage location of chord tendency information is identified on the basis of information (reference path) described in a "chord tendency information" field provided in musical performance setting data. Since musical performance setting data is provided for each musical piece, chord tendency information is associated with a musical piece. However, since some sets of musical performance setting data, that is, some musical pieces do not have any reference path in the "chord tendency information" field, chord tendency information is not necessarily stored to be associated with a musical piece. In this embodiment, however, chord tendency information corresponding to the target musical piece is always referred to before the process F which follows the process E to adjust the amount of points of each candidate chord. In a case where any chord tendency information is not stored anywhere, therefore, the CPU 5 is to generate chord tendency information corresponding to the target musical piece on the basis of music content data (see FIG. 4(*b*)) of the target musical piece. The generation of chord tendency information will be described in detail later.

As described above, in response to the user's selection and musical performance of a musical piece that the user desires to play, the chord detection apparatus of this embodiment retrieves chord tendency information corresponding to the selected musical piece and detects chords which suit the image of the musical piece in accordance with the chord tendency information. Therefore, the chord detection apparatus eliminates user's effort to enable user's intended chord detection such as an effort to include a root of a chord in notes that the user plays without fail. As a result, the chord detection apparatus allows the user to focus on playing the musical piece.

Furthermore, the chord detection apparatus will not rigidly fix chord progression by, for example, sequentially reading out chords in accordance with chord progression previously stored for a user's selected musical piece, but only facilitates detection of chords which suit the image and notes (musical performance data) of the selected musical piece. Therefore, even if the user arranges the musical piece as the user desires during the user's musical performance, or adds or omits a repeat as the user desires, the chord detection apparatus can always achieve the chord detection which suits the image and the notes of the musical piece. Resultantly, the chord detection apparatus enables a wide variety of musical performances with various arranges, also keeping the image of the musical piece.

Figure 5A:
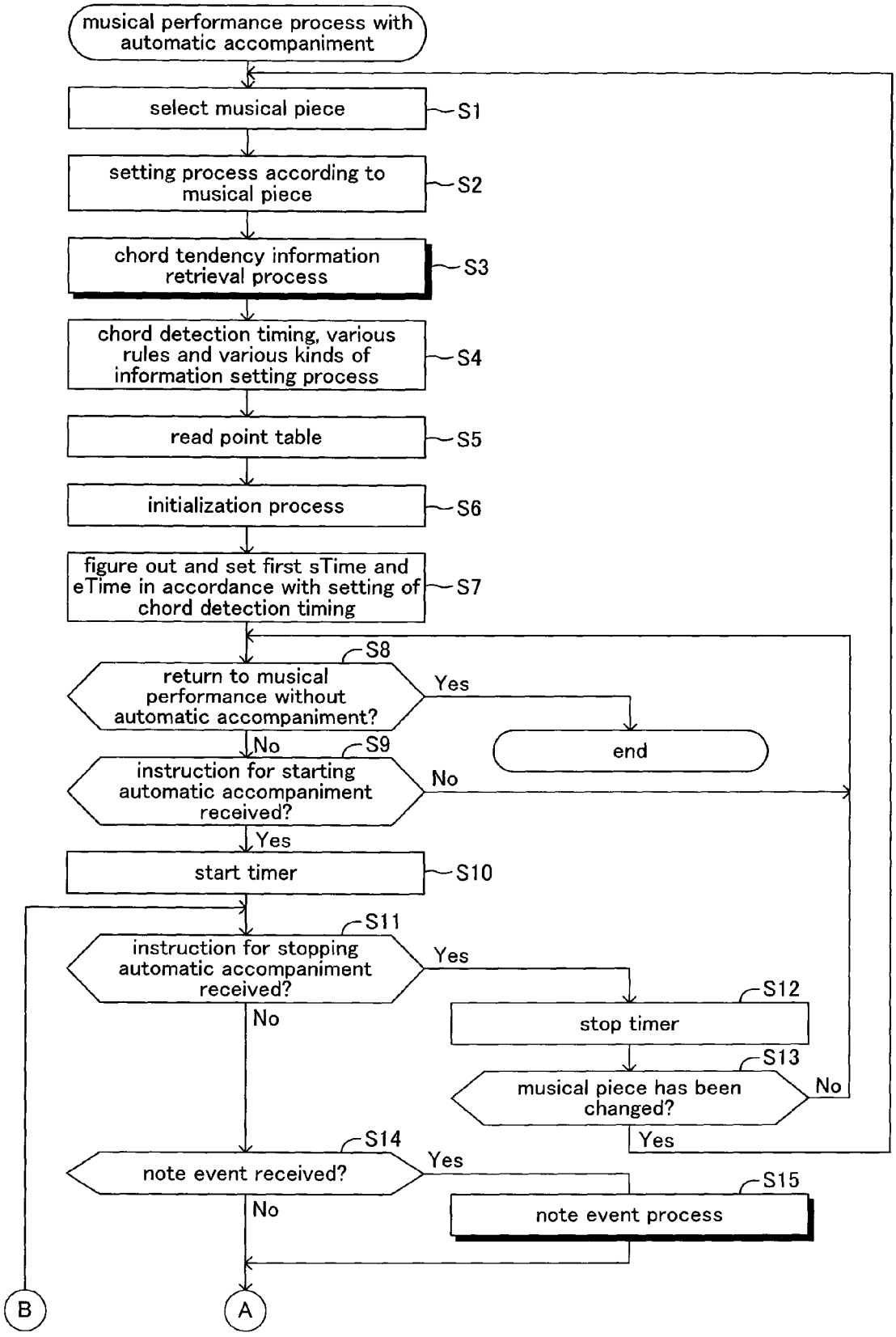
FIG. 5A is a flowchart indicative of the first half of a musical performance process using automatic accompaniment executed by the chord detection apparatus, particularly a CPU shown in FIG. 1.
Figure 5B:
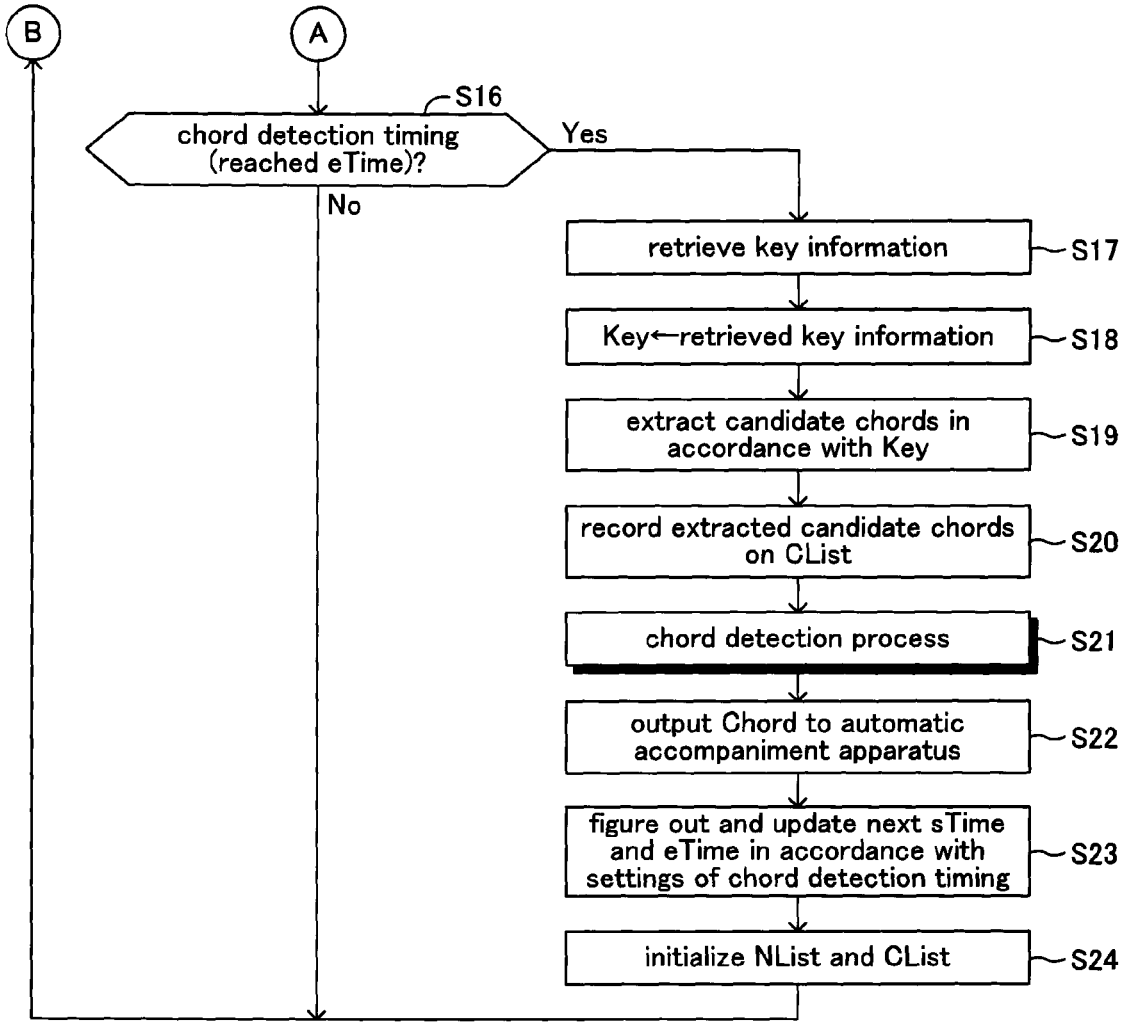
FIG. 5B is a flowchart indicative of the latter half of the musical performance process.

Next, the control processing will be explained in detail. FIG. 5A and FIG. 5B indicate a flowchart of a musical performance process with automatic accompaniment, the process being carried out by the chord detection apparatus particularly, by the CPU 5 of the embodiment. The chord detection apparatus of the embodiment has first and second musical performance modes as musical performance mode for user's real-time musical performance by use of the performance operating elements 1. In the first musical performance mode, musical tones corresponding to musical performance data input by use of the performance operating elements 1 are generated without operating the automatic accompaniment apparatus 9. In the second musical performance mode, the automatic accompaniment apparatus 9 is operated so that not only musical tones corresponding to musical performance data input by use of the performance operating elements 1 but also musical tones (accompaniment tones) corresponding to musical performance data generated by the automatic accompaniment apparatus 9 can be generated. A normal musical performance mode, that is, the musical performance mode first selected at turn-on of the chord detection apparatus of the embodiment is the first musical performance mode. For moving to the second musical performance mode, a user has to make certain directions for entering the second musical performance mode. The above-described "musical performance process with automatic accompaniment" is a process started in response to the directions for entering the second musical performance mode. In this embodiment, all the features of the present invention are incorporated in the "musical performance process with automatic accompaniment" so that the features of the present invention will be explained through the "musical performance process with automatic accompaniment". Therefore, a "musical performance process without automatic accompaniment" will not be explained. Hereafter, therefore, the "musical performance process with automatic accompaniment" will be simply referred to as a "musical performance process".

The musical performance process is mainly formed of processes (1) to (5):

(1) a start-up process (steps S1 to S7 of FIG. 5A);

(2) an automatic accompaniment start process (step S10 of FIG. 5A);

(3) an automatic accompaniment stop process (step S12 of FIG. 5A);

(4) a note event process (step S15 of FIG. 5A); and (5) a chord detection timing process (steps S17 to S24 of FIG. 5B).

When the musical performance process is started, the above-described start-up process (1) (steps S1 to S7) is carried out once. After the start-up process, the chord detection apparatus stays on a standby state until instruction for starting automatic accompaniment is given (step S8→S9→S8). If the instruction for starting automatic accompaniment is given, the above-described automatic accompaniment start process (2) (step S10) is carried out. After the automatic accompaniment start process, the above-described note event process (4) and chord detection timing process (5) (step S15 and steps S17 to S24) are carried out. The processes (4) and (5) are repeated until instruction for stopping automatic accompaniment is given (step S11) or instruction for returning to the first musical performance mode is given (step S8). If the instruction for stopping automatic accompaniment is given, the above-described automatic accompaniment stop process (3) (step S12) is carried out. After the automatic accompaniment stop process, it is determined whether a musical piece has been changed or not (step S13). If the musical piece has been changed, the musical performance process returns to the above-described start-up process (1) (steps S1 to S7) (step S13→S1). If the musical piece has not been changed, the chord detection apparatus returns to the standby state (step S13→S8). If the instruction for returning to the first musical performance mode has been given, the musical performance process terminates (step S8→end).

The above-described start-up process (1) is formed of the following processes (11) to (16):

(11) a musical piece selection and setting process (steps S1 and S2);

(12) a chord tendency information retrieval process (step S3);

(13) a chord detection timing, various rules and various kinds of information setting process (step S4);

(14) a point table reading process (step S5);

(15) an initialization process (step S6); and

(16) a chord detection timing start point and end point calculation setting process (step S7).

When the musical performance process enters the start-up process (1), the CPU 5 carries out the musical piece selection and setting process (11) (steps S1 and S2). In the musical piece selection and setting process (11), the CPU 5 displays a list of titles of selectable musical pieces, for example, on the display device 10. If the user selected any one of the musical pieces from the displayed title list, the CPU 5 reads out musical performance setting data corresponding to the selected musical piece (step S1), and writes various set values described in the musical performance setting data into corresponding registers or the like to set the values (step S2). In a case where a title of a musical piece "○○○" was selected, for example, since the musical performance setting data on the musical piece "○○○" has an accompaniment style "pop 1", a melody tone color "Grand Piano", and the like as indicated in FIG. 4(*a*), these set values are supplied to the corresponding registers or the like. Setting items (parameters) which are not shown include a musical performance tempo, a volume value, and a time.

Figure 6:
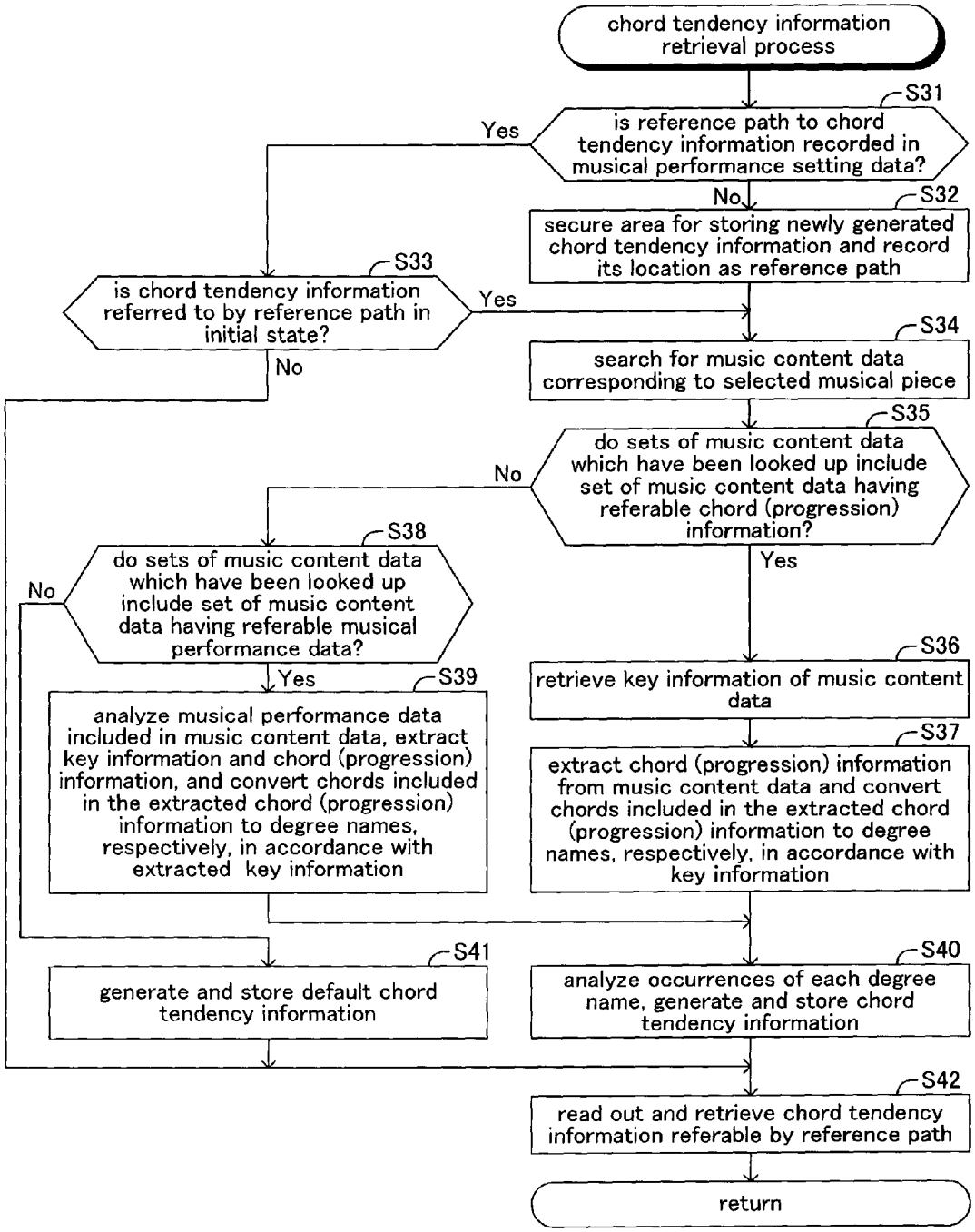
FIG. 6 is a flowchart indicative of detailed procedures of a chord tendency information retrieval process indicated in FIG. 5A.

Then, the CPU 5 proceeds to the above-described chord tendency information retrieval process (12) (step S3). FIG. 6 is a flowchart indicative of detailed procedures of the chord tendency information retrieval process (12). In this chord tendency information retrieval process, chord tendency information indicated as an example in FIG. 4(*c*) is retrieved.

In this embodiment, chord tendency information is stored in a location which is different from a location where musical performance setting data is stored, while information indicating the storage location of the chord tendency information (as the information, this embodiment employs "reference path") is recorded in a "chord tendency information" field of the musical performance setting data (see FIG. 4(*a*)). In some cases, however, there can be musical performance setting data in which any reference path for chord tendency information is not recorded. Furthermore, there can be cases where even if musical performance setting data has reference path for chord tendency information, any effective chord tendency information is not stored in the storage location. In the chord tendency information retrieval process, therefore, chord tendency information can be retrieved by respective manners in the following cases (C1) to (C3):

(C1) a case where it is necessary to newly generate chord tendency information to retrieve, for musical performance setting data does not have any reference path for chord tendency information, which means that there is no chord tendency information to retrieve;

(C2) a case where it is necessary to newly generate chord tendency information to retrieve, for musical performance setting data has reference path for chord tendency information, but the chord tendency information that can be referred to by the reference path is in an initial state (more specifically, although a storage area for chord tendency information is secured, no effective chord tendency information is stored in that area); and (C3) a case where a reference path for chord tendency information is recorded on musical performance setting data, while the chord tendency information referred to by the reference path is not in the initial state unlike the above-described case (C2) but is effective, so that the chord tendency information can be retrieved.

Assume that the chord tendency information retrieval process is started in the above-described case (C1). Since any reference path for chord tendency information is not recorded on the musical performance setting data, that is, since there is no chord tendency information that the CPU 5 can retrieve, the CPU 5 secures an area where chord tendency information will be newly generated to be stored in the storage device 11, for example, generates information indicative of the location of the area as a form of a reference path, and records the generated information in a certain position (in the "chord tendency information" field, in FIG. 4 (*a*)) of the musical performance setting data (step S31→S32).

Then, the CPU 5 searches for music content data corresponding to the selected musical piece (step S34). The location which the CPU 5 is to search may be anywhere as long as the CPU 5 can search. The location can be inside the chord detection apparatus of this embodiment such as the ROM 6, the RAM 7 and the storage device 11. Furthermore, the location can be outside the chord detection apparatus of this embodiment such as a storage medium of the external apparatus 100. In a case where the chord detection apparatus is connected to the Internet through the communication I/F 12, the CPU 5 can search a server computer connected with the Internet. As described above, since there are many locations to search, there are cases where the CPU 5 can find sets of music content data for one musical piece. The above-described music content data shown in FIG. 4(*b*) is one of the sets of data. The shown music content data having the title "○○○" has chord progression information, musical performance data and additional information. However, music content data may be formed of musical performance data and additional data without chord progression information, or may be formed of chord progression information and additional information without musical performance data. Furthermore, although musical performance data of the shown music content data is MIDI data, musical performance data may be audio data. Alternatively, a part of a set of musical performance data may be MIDI data, while the other part of the set of musical performance data may be audio data.

Then, the CPU 5 carries out different processes for three different cases (C11) to (C13), respectively:

(C11) a case where sets of music content data looked up by the CPU 5 include a set of music content data having chord (progression) information that the CPU 5 can refer to;

(C12) a case where sets of music content data looked up by the CPU 5 do not include any set of music content data having chord (progression) information that the CPU 5 can refer to, but include a set of music content data having musical performance data that the CPU 5 can refer to; and (C13) a case where sets of music content data looked up by the CPU 5 include neither music content data having chord (progression) information that the CPU 5 can refer to nor music content data having musical performance data that the CPU 5 can refer to.

In the above-described case (C11), the CPU 5 retrieves key information of the music content data (step S35→S36). In a case where the music content data includes key information, the CPU 5 reads out the key information to retrieve the key information. In a case where the music content data does not include key information, the CPU 5 may analyze the music content data (chord (progression) information or musical performance data) to extract and retrieve key information.

Then, the CPU 5 extracts chord (progression) information from the music content data, and converts chords included in the chord (progression) information to degree names, respectively, in accordance with the retrieved key information (step S37). The chords converted into degree names are temporarily stored in a working area of the RAM 7, for example.

The CPU 5 then analyzes occurrences of each degree name, generates chord tendency information, and stores the generated chord tendency information in a storage area indicated by a reference path recorded on the musical performance setting data (step S40). In this embodiment, as indicated in FIG. 4(*c*), chord tendency information indicates elements classified as being "likely to appear" or "unlikely to appear" in one or more categories for the target musical piece, with priority order being given. Although the chord tendency information shown in the figure has the categories "degree name", "scale degree of chord root (scale degree of chord root relative to key (tonic))", "chord type" and "function" (function represents tonic (T), dominant (D), subdominant (S) or subdominant minor (SM)), the categories may include chord names themselves. In this embodiment, the priority order is represented by "%" to indicate the rate of occurrence of each element included in the categories of "being likely to appear". However, the priority order may be represented by a point value or probability.

In the above-described case (C12), the CPU 5 analyzes musical performance data included in the music content data, extracts key information and chord progression information, and converts chords included in the extracted chord (progression) information to degree names in accordance with the extracted key information (step S35→S38→S39). The chords converted into degree names, respectively, are temporarily stored in the working area of the RAM 7, similarly to the above-described step S37. The CPU 5 then proceeds to step S40. The explanation of step S40 will not be repeated.

In the above-described case (C13), the CPU 5 generates default chord tendency information, and stores the generated chord tendency information in a storage area indicated by a reference path recorded on the musical performance setting data (step S35→S38→S41).

Then, the CPU 5 reads out the chord tendency information from the storage area that can be referred to by the reference path recorded on the musical performance setting data, and stores the chord tendency information in a chord tendency information storage area (not shown) provided on the RAM 7 for storing chord tendency information (step S42).

Assume that the chord tendency information retrieval process is started in the above-described case (C2). In this case, although the musical performance setting data has a reference path to chord tendency information, the chord tendency information indicated by the reference path is in the initial state. Therefore, the CPU 5 proceeds to the above-described step S34. Since the step S34 and later steps have been already explained, the explanation of these steps will not be repeated here. By the execution of step S34 and later steps, the initial chord tendency information is replaced with effective chord tendency information, so that the new chord tendency information is stored in the chord tendency information storage area.

Furthermore, assume that the chord tendency information retrieval process is started in the above-described case (C3). In this case, since the musical performance setting data has a reference path to effective chord tendency information, the CPU 5 reads out the chord tendency information from a storage area indicated by the reference path recorded on the musical performance setting data, and stores the chord tendency information in the chord tendency information storage area (step S31→S33→S42).

The process then returns to FIG. 5A, so that the CPU 5 proceeds to the chord detection timing, various rules and various kinds of information setting process (13) (step S4). In the chord detection timing, various rules and various kinds of information setting process, the CPU 5 sets a rule for setting chord detection timing, the other rules and various kinds of information.

The chord detection timing setting rule defines whether a period of time is provided as the chord detection timing, or the chord detection timing is prescribed by point in time without any period of time being provided. In a case where a period of time is provided as the chord detection timing, the chord detection timing setting rule also defines a reference position, and frontward and backward periods provided before and after the reference position. In a case where the chord detection timing is prescribed by point in time, the chord detection timing setting rule also defines points in time which serve as the chord detection timing. FIG. 2 indicates one example of a period of time in which every second beat (e.g., the first and third beats in a case of four-four time) is defined as the chord detection reference position, with a period starting 250 ms earlier and ending 50 ms later than each chord detection reference position being provided as the period of time. In the shown example, "ms" is employed as unit for defining the time period. However, the unit is not limited to "ms", but may be note length. Furthermore, the chord detection reference position is not limited to every second beat, but may be every beat. Alternatively, the chord detection reference position may be changed from every second beat to every beat, for example, in response to a tempo change. Furthermore, the chord detection reference position may be prescribed not by beat but by a specific position of each bar (e.g., top of each bar). Furthermore, the chord detection reference position may be determined according to tempo value or accompaniment style. On the other hand, examples of the point in time include the various chord detection reference positions indicated in the cases of a period of time, that is, every certain beat and a specific position of each bar. The examples of the point in time also include a point in time when a user manipulates a certain operating element included in the setting operating elements 2 or a point in time when the user manipulates the certain operating element within a certain amount of beats. However, this embodiment employs the rule indicated in FIG. 2 as the chord detection timing setting rule.

The other rules include a key information detection rule (R1) and a candidate chord extraction rule (R2).

As the key information detection rule (R1), for example, the following rules (R1a) and (R1b) can be employed:

(R1a) a rule by which a user is asked about key information before starting a musical performance to detect (retrieve) the key information input by the user in response to the inquiry; and (R1b) a rule by which musical performance data input by user's operation for musical performance is analyzed to detect key information as necessary.

In this embodiment, key information which is to be input by the user or to be detected is represented by a "tonic name+major/minor". As a method for analyzing musical performance data to detect key information, any well-known method can be employed. In a case where the rule by which key information is detected as necessary is employed, it is preferable that key information is stored at each chord detection (see step S76 of FIG. 8 which will be described later) such that the detected key information is associated with the detected chord.

As the candidate chord extraction rule (R2), for example, the following rules (R2a) to (R2c) can be employed:

(R2a) a rule by which only diatonic chords of the key are extracted;

(R2b) a rule by which all the chords that can be used in the key are extracted; and (R2c) a rule which extracts chords which are included in chords that can be used in the key and whose one or more constituent notes are included in target musical performance data (in note event information registered in a later-described note event list NList).

The various kinds of information include the degree name point table and the chord tendency information. The setting of the degree name point table means the selection of a table from among different kinds of tables and the edit of point values of the table in accordance with user's instructions. The setting of the chord tendency information means the edit of the chord tendency information stored in the chord tendency information storage area in accordance with user's instructions.

Then, the CPU 5 proceeds to the point table reading process (14) (step S5). In this point table reading process, the CPU 5 reads the above-selected degree name point table, and stores the table in a point table storage area (not shown) provided on the RAM 7. In this embodiment, as indicated in FIG. 3, the degree name point table is integral with the chord priority point table (Prior), so that the CPU 5 can simply read the degree name point table. In a case where the chord priority point table is provided separately, however, it is necessary to read not only the degree name point table (without the chord priority point table) but also the separately provided chord priority point table.

Then, the CPU 5 proceeds to the initialization process (15) (step S6). In this initialization process (15), the CPU 5 initializes, that is, clears respective areas, a note event list NList, a chord detection timing start point sTime, a chord detection timing end point eTime of, a key information Key, a chord list CList, and a detected chord Chord which are provided on the RAM 7:

note event list NList: a list in which note event information (tone pitch+input timing) corresponding to note-on events input within the period of chord detection timing are listed (registered);

chord detection timing start point sTime: an area for storing a start point of chord detection timing;

chord detection timing end point eTime: an area for storing an end point of chord detection timing;

key information Key: an area for storing key information detected on the basis of the set key detection rule;

chord list CList: a list in which candidate chords extracted on the basis of the set candidate chord extraction rule are listed (registered); and detected chord Chord: an area for storing one chord name selected from the chord list CList.

Then, the CPU 5 proceeds to the chord detection timing start point and end point calculation setting process (16) (step S7). In this chord detection timing start point and end point calculation setting process (16), the CPU 5 figures out the start point and the end point of the first chord detection timing in accordance with the set chord detection timing setting rule. Furthermore, the CPU 5 stores (sets) the calculated start point in the start point sTime, and stores (sets) the calculated end point in the end point eTime. In this embodiment, a beat position of the top beat of a musical piece is defined as a chord detection reference position of chord detection timing, with a point in time which is 250 ms earlier than the beat position being defined as a start point of the chord detection timing. However, since the musical piece starts at the top beat, it is meaningless to figure out a position which is earlier than the start position of the musical piece at the time of the start of the musical piece to define the position as the start point sTime. In this case, therefore, it is preferable to define the beat position of the top beat, that is, the chord detection reference position as the start point sTime. In this case, however, even if a position which is 250 ms earlier than the beat position of the top beat is figured out to define the position as the start point sTime as the principle, the control processing is to only start at time which is later than the defined start point, and will not cause any problems on later processing.

If the start-up process (1) (steps S1 to S7) has been carried out once as described above, the CPU 5 waits for user's instructions for starting automatic accompaniment. If a user has instructed to start automatic accompaniment, the CPU 5 proceeds to the automatic accompaniment start process (2) (step S10) (step S9→S10). In the automatic accompaniment start process (2), the CPU 5 starts the timer 8 to make the timer 8 start counting time. The time counted by the timer 8 is supplied to the automatic accompaniment apparatus 9 as well, as described above. In the musical performance process, therefore, if accompaniment style data has been selected to be set, the automatic accompaniment apparatus 9 which is in the operating state reproduces the accompaniment style data on the basis of the counted time (time information) supplied from the timer 8, independently of the musical performance process.

Then, the CPU 5 carries out the note event process (4) (step S15) in response to reception of a note-on event until user's instruction for stopping automatic accompaniment (step S11→S14→S15). When the timer 8 has counted to reach (the end point eTime of) the chord detection timing, the CPU 5 carries out the chord detection timing process (5) (steps S17 to S24) (step S16→S17 of FIG. 5B).

If the user instructs to stop the automatic accompaniment, the CPU 5 proceeds to the automatic accompaniment stop process (3) (step S12) (step S11→S12). In the automatic accompaniment stop process (3), the CPU 5 stops the timer 8. As a result, the reproduction of the accompaniment style data by the automatic accompaniment apparatus 9 is stopped.

Figure 7:
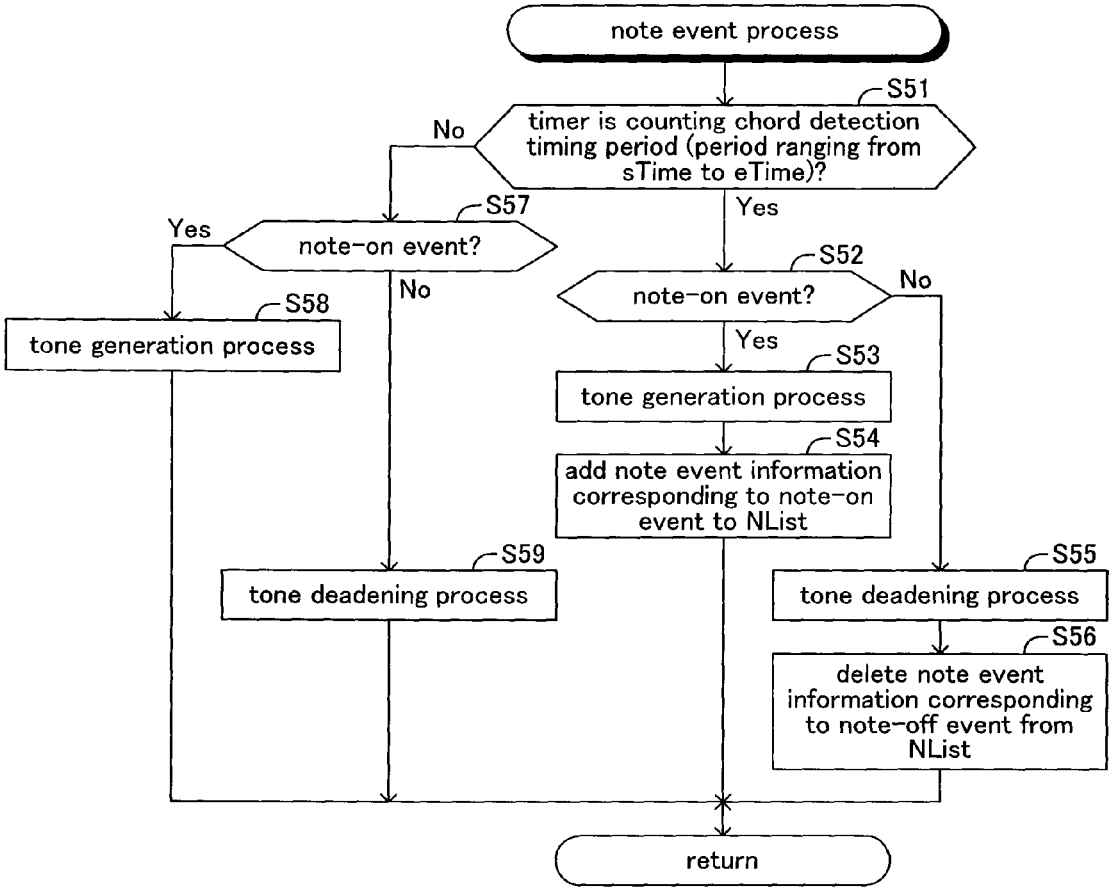
FIG. 7 is a flowchart indicative of detailed procedures of a note event process indicated in FIG. 5A.

FIG. 7 is a flowchart indicative of detailed procedures of the note event process (4) (step S15). As indicated in FIG. 7, the note event process has the following processes (41) and (42):

(41): while the timer 8 is counting a chord detection timing period, that is, is counting the period ranging from the start point sTime to the end point eTime, the following processes (41a) and (41b) are carried out:

(41a): a process (steps S53 and S54) of a case where a note-on event has been accepted; and (41b): a process (steps S55 and S56) of a case where a note-off event has been accepted; and (42): while the timer 8 is counting time which is not the chord detection timing period, the following process (42a) and (42b) are carried out:

(42a): a process (step S58) of a case where a note-on event has been accepted; and (42b): a process (step S59) of a case where a note-off event has been accepted.

The above-described process (41a) (steps S53 and S54) is formed by adding a process of adding note event information (tone pitch+input timing) corresponding to the note-on event into the note event list NList to the above-described process (42a) (step S58), that is, a tone generation process by which the accepted note-on event is output to the tone generator/effect circuit 13. The above-described process (41b) (steps S55 and S56) is formed by adding a process of deleting note event information corresponding to the note-off event from the note event list NList to the above-described process (42b) (step S59), that is, a tone deadening process by which the accepted note-off event is output to the tone generator/effect circuit 13.

Hereafter, the above-described steps S54 and S56 will be explained in detail. By step S54, note event information indicative of acceptance of a note-on event after the start point sTime of the chord detection timing is added to the note event list NList. By step S56, note event information indicative of acceptance of a note-off event before the end point eTime of the chord detection timing is deleted from the note event list NList. In the note event list NList, therefore, only note event information indicative of keys which have been depressed during the period ranging from the start point sTime to the end point eTime, and are still kept depressed at the end point eTime is stored. Even if there is a key which is kept depressed at the end point eTime and later but was depressed before the start point sTime, note event information indicative of the key is not stored in the note event list NList. Furthermore, even if there is a key which had been depressed after the start point sTime but has been released before the end point eTime, note event information indicative of the key is not stored in the note event list NList. In this case, it is possible to exclude note event information indicative of erroneously depressed keys (keys released immediately after depression of the keys) from the note event list NList by shortening the period from the start point sTime to the end point eTime.

As for steps S54 and S56, it is possible to omit step S56. In a case where step S56 is omitted, the note event list NList is to store note event information indicative of all the keys which have been depressed during the period ranging from the start point sTime to the end point eTime.

In the chord detection timing process (5) (steps S17 to S24), the CPU 5 retrieves key information (step S17) in accordance with the key detection rule set by the chord detection timing, various rules and various kinds of information setting process (13) (step S4), and stores the retrieved key information in the key information Key (step S18).

Then, the CPU 5 extracts candidate chords in accordance with the key information Key (step S19). The extraction of candidate chords is also performed in accordance with the candidate chord extraction rule set by the key detection rule set by the chord detection timing, various rules and various kinds of information setting process (13) (step S4). Then, the CPU 5 records the candidate chords extracted at step S19 on the chord list CList (step S20).

Figure 8A:
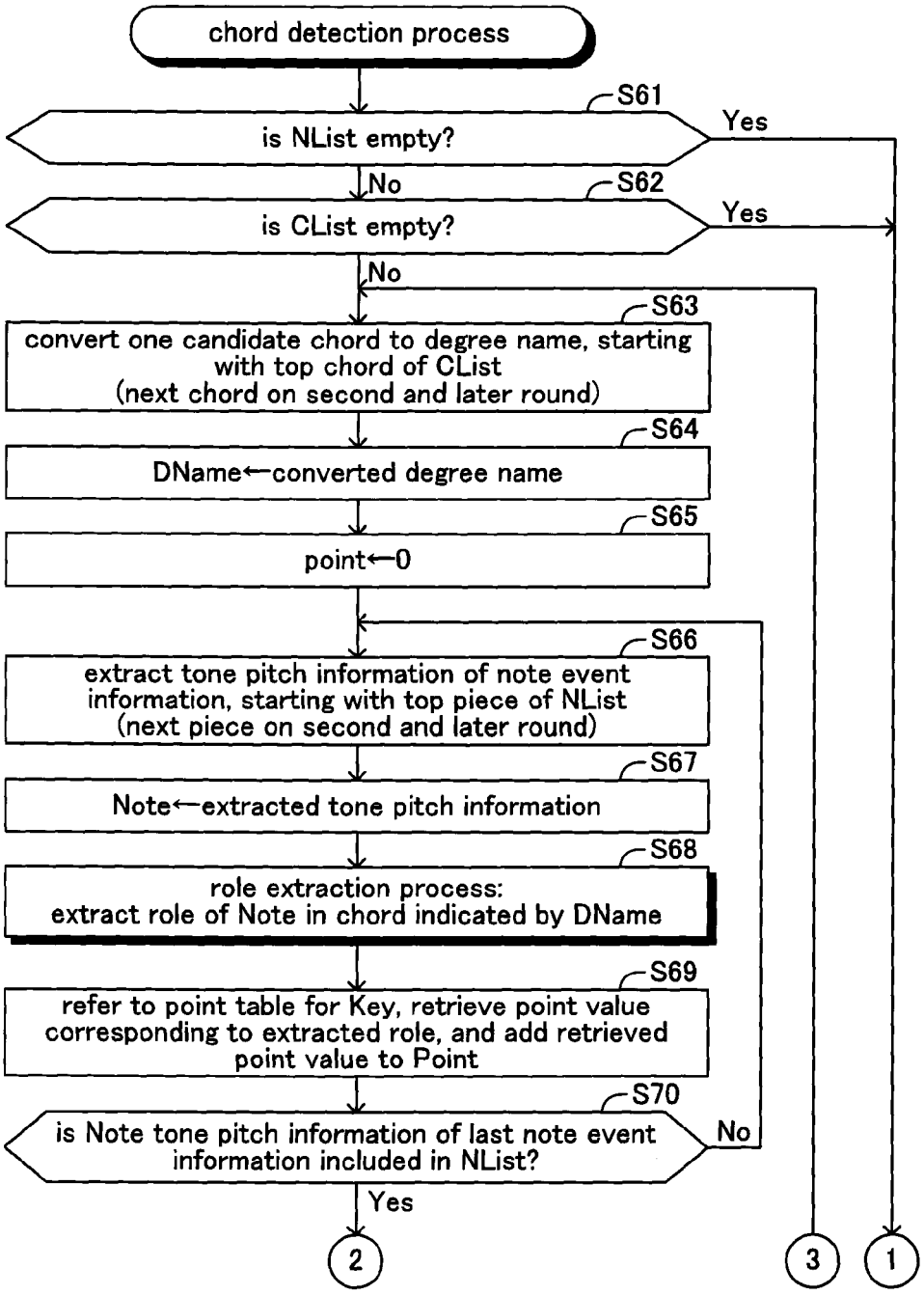
FIG. 8A is a flowchart indicative of the first half of detailed procedures of a chord detection process indicated in FIG. 5B.
Figure 8B:
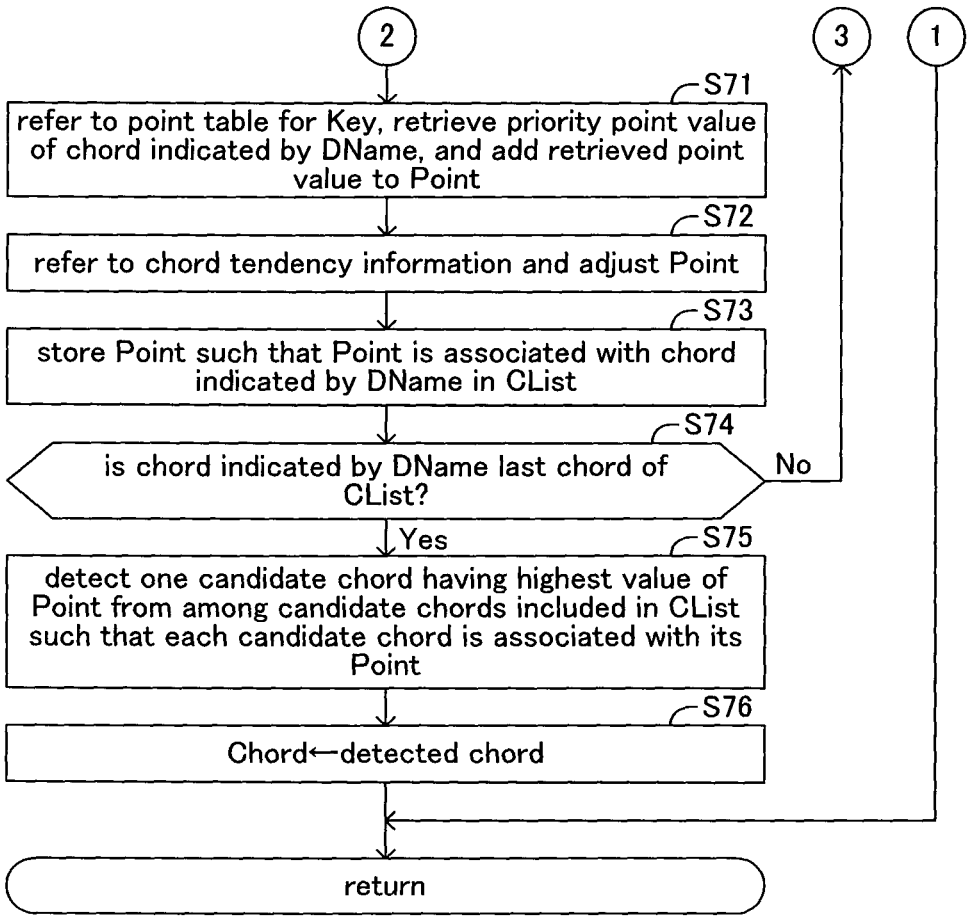
FIG. 8B is a flowchart indicative of the latter half of the detailed procedures of the chord detection process.

Then, the CPU 5 carries out a chord detection process for detecting (selecting) one chord on the basis of the note event list NList and the chord list CList (step S21). FIG. 8A and FIG. 8B are a flowchart indicative of detailed procedures of the chord detection process. The chord detection process is mainly formed of processes (21) to (24):

(21) a point calculation process (steps S63 to S71) for calculating the amount of points of one chord included in the candidate chords recorded on the chord list CList, in accordance with the note event list NList and the degree name point table;

(22) a point adjustment process (step S72) for adjusting the amount of points calculated by the point calculation process in accordance with the chord tendency information;

(23) a storage process (step S73) for storing the amount of points adjusted by the point adjustment process so that the points can be associated with the one candidate chord listed on the chord list CList; and

(24) a detection process (steps S75 and S76) for detecting a candidate chord from the chord list CList on which the storage process has been performed.

When the chord detection process is started, the CPU 5 judges whether at least either the note event list NList or the chord list CList is empty or not, that is, whether at least either the note event list NList or the chord list CList does not have any recorded information. If it is determined that at least either of them does not have any information, the CPU 5 immediately terminates the chord detection process (step S61→return, or step S61→S62→return). If it is determined that both of them have information, the CPU 5 proceeds to the point calculation process (21) (step S62→S63).

In the point calculation process (21) (steps S63 to S71), the CPU 5 converts a candidate chord listed on the top of the chord list CList to a degree name (step S63). The CPU 5 then stores the converted degree name in a degree name storage area DName (not shown) provided on the RAM 7 in order to store degree names (step S64). Hereafter, the degree name stored in the degree name storage area DName is referred to as a "degree name DName".

Then, the CPU 5 initializes a point amount addition area Point (not shown) provided on the RAM 7 in order to add points to "0" (step S65). Hereafter, the point amount stored in the point amount addition area Point is referred to as a "point amount Point".

Then, the CPU 5 extracts tone pitch information included in the top piece of note event information recorded on the event list NList (step S66). Then CPU 5 then stores the extracted tone pitch information in a tone pitch information storage area Note (not shown) provided on the RAM 7 in order to store tone pitch information. Hereafter, the tone pitch information stored in the tone pitch information storage area Note is referred to as "tone pitch information Note".

Then, the CPU 5 extracts a role of the tone pitch information Note in a chord represented by the degree name DName (step S68). The "role" extracted in this step is "root", "third", "fifth", "fourth note", "altered", "tension note" or "other (avoid note or the like)" indicated in the degree name point table shown in FIG. 3. Although the extraction method is described in the above-described Japanese Unexamined Patent Publication No. 2012-98480 described in Description of the Related Art, the extraction method will be explained as a role extraction process with reference to FIG. 9A and FIG. 9B.

Figure 9A:
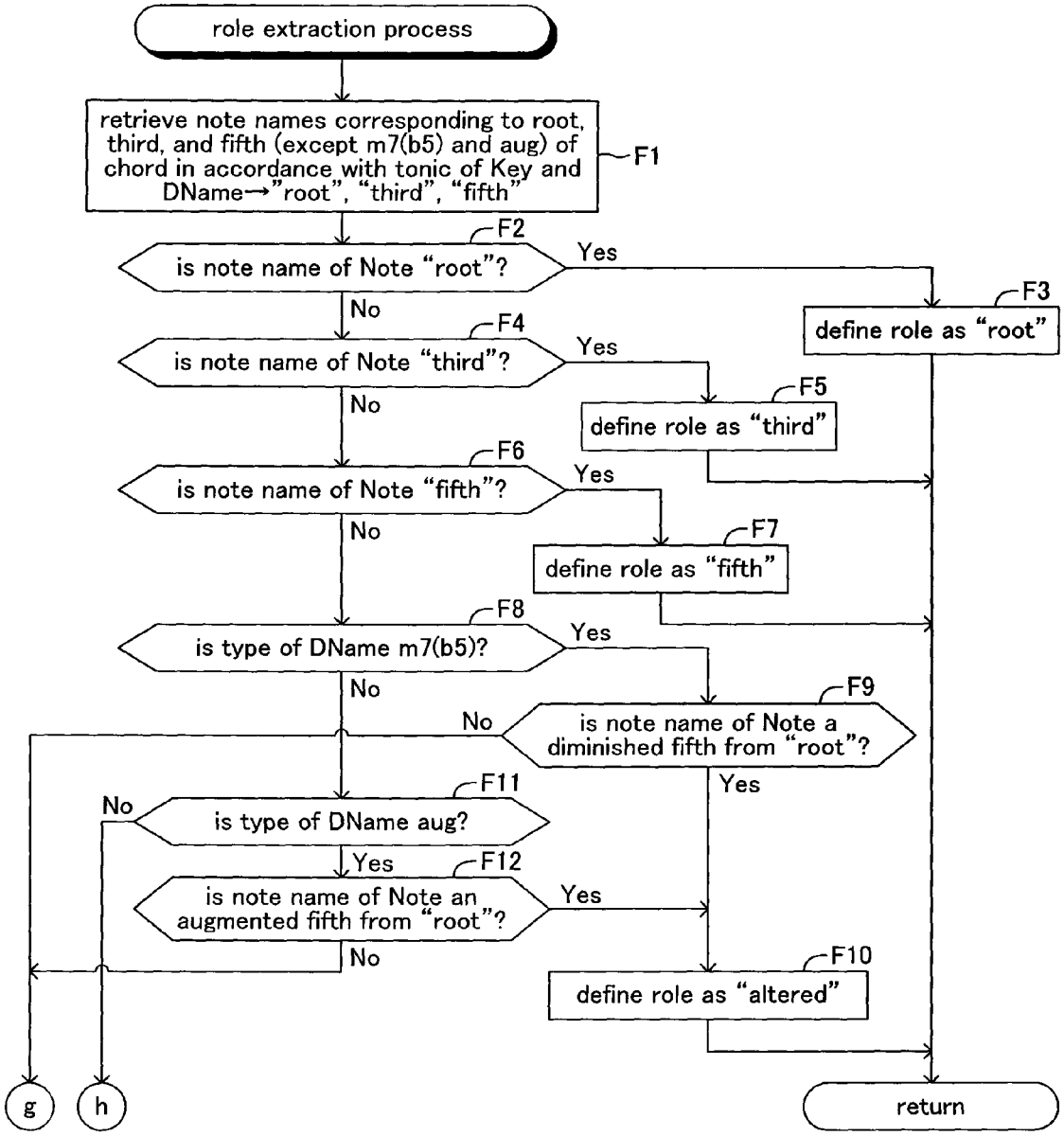
FIG. 9A is a flowchart indicative of the first half of detailed procedures of a role extraction process indicated in FIG. 8A.
Figure 9B:
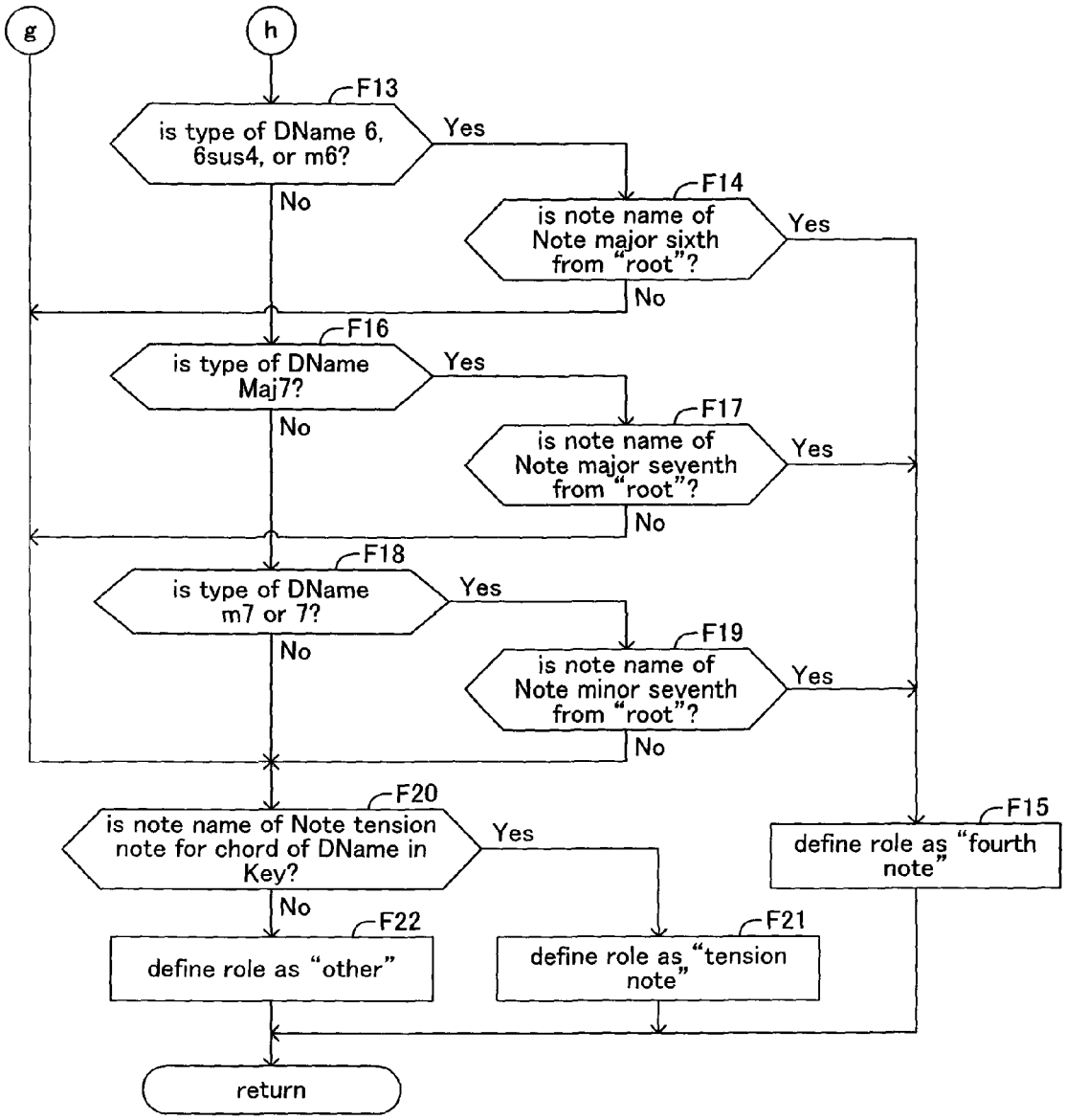
FIG. 9B is a flowchart indicative of the latter half of the detailed procedures of the role extraction process.

FIG. 9A and FIG. 9B indicate detailed procedures of the role extraction process of step S68. At the first step F1, the CPU 5 retrieves note names corresponding to the root, third and fifth (except minor seventh flat fifth (m7(♭5)), and augmented) of the chord in accordance with the tonic of the key information Key and the degree name DName, and stores the retrieved note names in a "root" register, a "third" register and a "fifth" register provided in the RAM 7. Respective semitone distances of a root, a third and a fifth from a tonic are determined according to chord type. In a case where Key is CMajor, with Degree Name being IVMaj7, for example, the "root" is F, the "third" is A, and the "fifth" is C.

At the next step F2, the CPU 5 judges whether or not the note name of the tone pitch information Note is equal to the value of the "root" register. If the note name is equal to the value of the "root" register (F2=YES), the CPU 5 defines the role of the tone pitch information Note as "root" at step F3. If not (F2=No), the CPU 5 proceeds to step F4. At step F4, the CPU 5 judges whether or not the note name of the tone pitch information Note is equal to the value of the "third" register. If the note name is equal to the value of the "third" register (F4=YES), the CPU 5 defines the role of the tone pitch information Note as "third" at step F5. If not (F4=No), the CPU 5 proceeds to step F6. At step F6, the CPU 5 judges whether or not the note name of the tone pitch information Note is equal to the value of the "fifth" register. If the note name is equal to the value of the "fifth" register (F6=YES), the CPU 5 defines the role of the tone pitch information Note as "fifth" at step F7. If not (F6=No), the CPU 5 proceeds to step F8. After the steps F3, F5 and F7, the CPU 5 terminates the role extraction process to return to step S69 of the chord detection process of FIG. 8.

At step F8, the CPU 5 judges whether or not the chord type of the degree name DName is "m7(♭5)" (minor 7th flat 5th). If the chord type is "m7(♭5)" (F8=YES), the CPU 5 proceeds to step F9 to judge whether or not the note name of the tone pitch information Note is a diminished fifth (♭5th) from the note name of the "root" register. If the note name of the tone pitch information Note is a diminished fifth (F9=YES), the CPU 5 defines the role of the tone pitch information Note as "altered" at step F10. On the other hand, if the chord type is not "m7(♭5)" (F8=NO), the CPU 5 proceeds to step F11 to judge whether or not the chord type of the degree name DName is "aug" (augmented). If the chord type is "aug" (F11=YES), the CPU 5 proceeds to step F12 to judge whether or not the note name of the tone pitch information Note is an augmented fifth (♯5th) from the note name of the "root" register. If the note name of the tone pitch information Note is an augmented fifth (F12=YES), the CPU 5 defines the role of the tone pitch information Note as "altered" at step F10. After step F10, the CPU 5 terminates the rule extraction process to return to step S69 of the chord detection process of FIG. 8.

If it is judged at step F11 that the chord type is not "aug" (F11=NO), the CPU 5 proceeds to step F13 (FIG. 9B) to judge whether or not the chord type of the degree name DName is "6", "6sus4" (6 suspended 4), or "m6" (minor 6). If the chord type is "6", "6sus4", or "m6" (F13=YES), the CPU 5 proceeds to step F14 to judge whether or not the note name of the tone pitch information Note is a major sixth (6th) from the note name of the "root" register. If the note name of the tone pitch information Note is a major sixth (F14=YES), the CPU 5 defines the role of the tone pitch information Note as "fourth note" at step F15. If it is judged at step F13 that the chord type is not any of "6", "6sus4", and "m6" (F13=NO), the CPU 5 proceeds to step F16 to judge whether or not the chord type of the degree name DName is a Maj7 (major 7) such as "I Maj7" (major 7 on the first degree) and "IV mMaj7" (minor major 7 on the fourth degree). If the chord type is a Maj7 (F16=YES), the CPU 5 proceeds to step F17 to judge whether or not the note name of the tone pitch information Note is a major seventh (Maj 7th) from the note name of the "root" register. If the note name of the tone pitch information Note is a major seventh (F17=YES), the CPU 5 defines the role of the tone pitch information Note as "fourth note" at step F15. If it is judged at step F16 that the chord type is not Maj7 (F16=NO), the CPU 5 proceeds to step F18 to judge whether or not the chord type of the degree name DName is m7 (minor 7) or 7th (seventh) such as "II m7" (minor 7 on the second degree), "V7" (seventh on the fifth degree), and "VII7sus4" (seventh suspended4 on the seventh degree). If the chord type is m7 or seventh (F18=YES), the CPU 5 proceeds to step F19 to judge whether or not the note name of the tone pitch information Note is a minor seventh (seventh) from the note name of the "root" register. If the note name of the tone pitch information Note is a minor seventh (F19=YES), the CPU 5 defines the role of the tone pitch information Note as "fourth note" at step F15. After step F10, the CPU 5 terminates the role extraction process to return to step S69 of the chord detection process of FIG. 8.

If it is judged at step F9 that the note name of the tone pitch information Note is not a diminished fifth (F9=NO), if it is judged at step F12 that the note name is not an augmented fifth (F12=NO), if it is judged at step F14 that the note name is not a major sixth (F14=NO), if it is judged at step F17 that the note name is not a major seventh (F17=NO), if it is judged at step F18 that the chord type is neither m7 nor 7 (F18=NO), or if it is judged at step F19 that the note name is not a minor seventh (F19=NO), the CPU 5 proceeds to step F20 to judge whether or not the note name of the tone pitch information Note is a tension note for the chord represented by the degree name DName of the current key Key. Respective semitone distances of tension notes from a root are determined according to chord type (one to three of ♭9th, 9th, ♯9th, 11th, ♯11th, ♭13th, and 13th). In a case where Key is CMajor, with Degree Name being IVMaj7, for example, tension notes are G, B and D. If it is judged that the note name of the tone pitch information Note is a tension note (F20=YES), the CPU 5 proceeds to step F21 to define the role of the tone pitch information Note as "tension note". If it is judged that the note name of the tone pitch information Note is not a tension note (F20=NO), the CPU 5 proceeds to step F22 to define the role of the tone pitch information Note as "other". After step F21 or F22, the CPU 5 terminates the role extraction process to return to step S69 of the chord detection process of FIG. 8.

After the role extraction process of step S68 of FIG. 8, the CPU 5 refers to the degree name point table (point table for the key information Key) of the key indicated by the key information Key, retrieves a point value corresponding to the extracted role, and adds the retrieved point value to the point amount Point (step S69). Since the amount of point Point is "0" at this time, the point value retrieved at step S69 is directly assumed to be the point amount Point.

Then, the CPU 5 repeats the above-described steps S66 to S69 with a target piece of note event information being changed until the tone pitch information of the last piece of note event information included in the note event list NList (step S70→S66). When the CPU 5 has treated the tone pitch information of the last piece of note event information included in the note event list NList to proceed to step S70, the CPU 5 proceeds to the next step S71.

At step S71, the CPU 5 refers to the degree name point table (point table for the key information Key) of the key indicated by the key information Key, retrieves priority points of the chord indicated by the degree name DName, and adds the retrieved points to the point amount Point. Although priority points are described in the chord priority point table (Prior), the chord priority point table (Prior) is included in the degree name point table as described above. Therefore, the priority points are to be retrieved from the degree name point table, that is, from the point table for the key information Key.

Then, the CPU 5 proceeds to the point adjustment process (22) (step S72). In this point adjustment process (22), the CPU 5 adjusts the amount of points Point on the basis of chord tendency information as follows.

(22*a*) In a case where the chord indicated by the degree name DName is included in the "degree names likely to appear" in the chord tendency information, a certain value corresponding to the likelihood is reflected in the amount of points Point. In a case where the chord indicated by the degree name DName is included in the "degree names unlikely to appear" in the chord tendency information, a certain value corresponding to the unlikelihood is reflected in the amount of points Point.

(22*b*) In a case where the scale degree indicated by the degree name DName is included in the "scale degree of chord root likely to appear" in the chord tendency information, a certain value corresponding to the likelihood is reflected in the amount of points Point. In a case where the scale degree indicated by the degree name DName is included in the "scale degree of chord root unlikely to appear" in the chord tendency information, a certain value corresponding to the unlikelihood is reflected in the amount of points Point.

(22*c*) In a case where the chord type indicated by the degree name DName is included in the "chord types likely to appear" in the chord tendency information, a certain value corresponding to the likelihood is reflected in the amount of points Point. In a case where the chord type indicated by the degree name DName is included in the "chord types unlikely to appear" in the chord tendency information, a certain value corresponding to the unlikelihood is reflected in the amount of points Point.

(22*d*) In a case where the chord function indicated by the degree name DName is included in the "function likely to appear" in the chord tendency information, a certain value corresponding to the likelihood is reflected in the amount of points Point. In a case where the chord function indicated by the degree name DName is included in the "chord function unlikely to appear" in the chord tendency information, a certain value corresponding to the unlikelihood is reflected in the amount of points Point.

The term "reflect" means adjusting to increase the amount of points Point for those "likely to appear", while the term "reflect" means adjusting to decrease the amount of points Point for those "unlikely to appear". In the chord tendency information of FIG. 4(*c*), the rate of appearance of those "likely to appear" is expressed in percentage (%) (however, since there is only one for "function", any rate of appearance is not indicated. However, the rate of the chord can be assumed to be 100%), while the rate of appearance is not indicated for those "unlikely to appear". By use of the chord tendency information, the amount of point Point is to be adjusted as follows, for example:

in a case of those "likely to appear": point+Tm×Rmn/100 in a case of those "unlikely to appear": point-Km in these cases, Tm, Rmn and Km are defined as follows:

Tm: total amount of points to be added for the m-th item (any of "degree name", "scale degree of chord root", "chord type" and "function");

Rmn: rate (%) of appearance of that which is the n-th element belonging to the m-th item, and is indicated by the degree name DName; and Km: the amount of points to be subtracted for the m-th item.

More specifically, the "certain value" for those "likely to appear" in the above-described cases (22a) to (22d) is "Tm×Rmn/100", while the "certain value" for those "unlikely to appear" is "Km". As a result, "the amount of points Point+Tm×Rmn/100", and "the amount of points Point-Km" are indices indicative of the probability of appearance of the chord, that is, the likelihood of the chord appearing and the unlikelihood of the chord appearing.

In a case where the chord indicated by the degree name DName is included in those indicated in the item "degree name", the scale degree and the chord type indicated by the degree name DName are included in the items "scale degree of chord root" and "chord type", respectively. In this case, however, the amount of points Point may be adjusted in every item. Alternatively, the amount of points Point may be adjusted only in one of the items to omit adjustment (not to adjust) in the other items. Although the item "function" indicates a single function in the example of FIG. 4(*c*), the item may indicate a progression of plural functions. In this case, however, a history of changes in detected chord Chord and key information Key has to be recorded.

Furthermore, the "certain value" may not necessarily be figured out on the basis of the appearance rate, but may be figured out by associating an amount of points to be added with each element included in each item so that an amount of points corresponding to an element can be simply added. In an item, more specifically, an element ranked in first place as "being likely to appear" is associated with +20 points with an element ranked in second place being associated with +10 points, and so on, while those elements defined as "being unlikely to appear" are associated with −10 points across the board. Of course, elements defined as "being unlikely to appear" may also be ranked so that the elements can have different points according to the ranking. Furthermore, the "certain value" may be reflected not by addition/subtraction but by multiplication/division.

Then, the CPU 5 proceeds to the storage process (23) (step S73) to store the amount of points Point adjusted as explained above so that the amount of points can be associated with the chord indicated by the degree name DName of the chord list CList.

Then, the CPU 5 repeats the above-described processes (21) to (23) (steps S63 to S73) with a target chord being changed until the last chord indicated by the degree name DName of the chord list CList (step S74→S63). When the CPU 5 has treated the last chord indicated by the degree name DName included in the chord list CList to proceed to step S74, the CPU 5 proceeds to the detection process (24) (steps S75 and S76).

In this detection process (24), from among the candidate chords stored in the chord list CList such that the respective candidate chords are associated with their respective amounts of points Point, the CPU 5 detects one candidate chord having the highest amount of points Point (step S75), defines the detected chord as the detected chord Chord (step S76), and terminates the chord detection process. In a case as well where there are two or more candidate chords having the highest amount of points Point, the CPU 5 is to detect one candidate chord at step S75. In this case, however, an additional condition such as the highest frequency of detection or the highest chord priority points is to be added to determine one candidate chord.

The CPU 5 returns to FIG. 5B to output the detected chord Chord to the automatic accompaniment apparatus 9 (step S22).

In accordance with the settings (setting rule) of the chord detection timing, the CPU 5 then figures out the start point and the end point of the next chord detection period, updates the start point sTime and the end point eTime (step S23), and initializes (clears) the note event list NList and the chord list CList (step S24).

In this embodiment, the selection of a musical piece is made by selecting a title of a desired musical piece listed on the title list displayed on the display device 10 included in the chord detection apparatus of this embodiment by manipulation of the operating elements (the setting operating elements 2 or the performance operating elements 1) or touch manipulation. However, a display device provided separately from the chord detection apparatus may be connected with the chord detection apparatus by wired or wireless connections so that the user can select a musical piece on the display device. Furthermore, the selection of a musical piece is made possible without a display screen by employing a scheme in which an operating element such as a button for directly selecting a musical piece and a booklet of a title list are provided for a user to allow the user to select a desired musical piece by manipulating the operating element for the number of times equal to the title number of the musical piece, for example. In other words, the display device 10 or the equivalent is not indispensable to the present invention as long as the user can select a musical piece by some scheme.

In this embodiment, furthermore, candidate chords are extracted on the basis of musical performance data input by user's musical performance to detect a chord from the extracted candidate chords. However, the embodiment may be modified to directly detect a chord without extracting candidate chords. As a method for detecting a chord, in this modification, a method of detecting a chord having the highest ratio of chord constituent notes to notes input by a musical performance, or a method of detecting a chord by giving a high priority to diatonic chords of a current key can be employed. To such a method, the chord detection based on chord tendency information according to the present invention may be applied. For instance, it is judged whether a detected chord matches chord tendency information. If not, a different chord is to be detected to judge whether the different chord matches the chord tendency information. In a case where there are a plurality of pieces of chord information that can be referred to for a target musical piece, it is possible to detect a chord corresponding to a key in which the musical piece is played. Furthermore, the chord detection may be modified to consider smooth links to previous chords which have been detected before.

In this embodiment, furthermore, musical performance data input by user's musical performance within a predetermined period is used for chord detection. However, the chord detection may be done by use only of musical performance data of predetermined timing. In this case, musical performance data on user's depressed keys in the predetermined timing are input to use the input musical performance data for chord detection.

In this embodiment, furthermore, as indicated in FIG. 4(*c*), chord tendency information has the four types "degree name", "scale degree of chord root", "chord type" and "function" so that all the types of the chord tendency information can be used. However, the embodiment may be modified such that chord tendency information has at least one of the four types to use the at least one type of the chord tendency information.

In this embodiment, furthermore, the chord tendency information is provided for each musical piece. However, the embodiment may be modified such that a user can define chord tendency information as necessary. In this embodiment, furthermore, a location where the chord tendency information is stored is described in musical performance setting data. However, the embodiment may be modified such that the chord tendency information itself is described (stored) in musical performance setting data. Although the chord tendency information is applied to the entire musical piece from the beginning to the end in this embodiment, the embodiment may be modified such that each section of a musical piece has a different kind of chord tendency information.

In this embodiment, as described above, on musical performance setting data provided for each musical piece, accompaniment style data, a melody tone color, a tempo and the like are described. On musical performance setting data, however, chord progression information for a whole musical piece and chord detection results involved in user's musical performance may be also recorded. In this case, it is preferable to control the chord detection such that suitable chords can be detected to fit a user's musical performance by using the recorded chord progression information as strongly recommended chords. Furthermore, sets of the musical performance setting data such as accompaniment style data and melody tone color may be provided for each musical piece. In this case, a user may be allowed to select a set of musical performance setting data to use. Alternatively, if the tempo of musical performance varies among the sets of musical performance setting data, a set of musical performance setting data may be automatically selected in accordance with previously set user's level of musical performance or in accordance with judgment based on user's previous musical performance. The musical performance setting data may be stored either in the chord detection apparatus itself or in a storage medium provided separately from the chord detection apparatus or an apparatus on which a chord detection program operates. Alternatively, the musical performance setting data may be referred to via a network.

In a case where chord progression information which suits the musical piece is not stored as a part of musical performance setting data, it is preferable to obtain chord progression information by some scheme. For instance, a storage portion (the storage device 11, and the ROM 6 and RAM 7) of the apparatus or a server via a network may be searched to find content data that can be used for the musical piece to refer to chord progression information recorded on the found content data. Alternatively, a chord part and a base part of the content data that can be used for the musical piece may be analyzed to obtain chord progression information.

Furthermore, it is needless to say that the object of the present invention can be achieved by supplying a storage medium which stores program codes of software that realizes the functions of the above-described embodiment to a system or an apparatus to allow a computer (or CPU and MPU) of the system or the apparatus to read and execute the program codes stored in the storage medium.

In this case, the program codes themselves read out from the storage medium are to realize novel functions of the present invention, while the program codes and the storage medium that stores the program codes are to constitute the present invention.

The storage medium for supplying the program codes can be a flexible disk, hard disk, magneto-optical disk, CD-ROM, CD-R, CD-RW, DVD-ROM, DVD-RAM, DVD-RW, DVD+RW, magnetic tape, nonvolatile memory card, ROM or the like. Alternatively, the program codes may be supplied from a server computer via a communication network.

Furthermore, it is needless to say that the functions of the above-described embodiment can be realized not only by a computer executing the read program codes, but also by an OS operating on the computer and the like to carry out a part of or the entire actual processing in accordance with instructions of the program codes so that the functions of the embodiment can be realized by the processing.

Furthermore, it is needless to say that after the program codes read out from the storage medium are written into a memory provided on a function expansion board inserted in the computer or a function expansion unit connected to the computer, a CPU provided on the function expansion board or the function expansion unit can carry out a part of actual processing or the entire actual processing in accordance with instructions of the program codes to realize the functions of the above-described embodiment by the processing.

What is claimed is:

1. A chord detection apparatus comprising:

a processor configured to execute:

a musical piece selecting task that selects a musical piece to be performed by a player;

a musical piece information retrieval task that retrieves musical piece information corresponding to the selected musical piece;

a chord tendency information retrieval task that retrieves chord tendency information indicative of degrees of likelihood or unlikelihood of chords appearing in the selected musical piece based on the retrieved musical piece information;

a musical performance data retrieval task that retrieves musical performance data of musical performance performed by the player; and a chord detection task that detects a chord based on the musical performance data retrieved by the musical performance data retrieval task and the chord tendency information retrieved by the chord tendency information retrieval task.

2. The chord detection apparatus according to claim 1, wherein the musical performance data retrieval task retrieves musical performance data of musical performance performed by the player during a predetermined period or in predetermined timing.

3. The chord detection apparatus according to claim 1, wherein the chord tendency information represents the degrees of likelihood or unlikelihood of chords being associated with at least one element of chord name, scale degree of chord root, chord type, and chord function.

4. The chord detection apparatus according to claim 1, wherein the chord tendency information retrieval task retrieves chord tendency information corresponding to the musical piece by reading out chord tendency information previously stored so that the chord tendency information is associated with the musical piece.

5. The chord detection apparatus according to claim 1, wherein the chord tendency information retrieval task retrieves chord tendency information corresponding to the musical piece by analyzing chord information or musical performance information previously stored so as to be associated with the musical piece.

6. A chord detection apparatus according to claim 1, wherein:

the chord detection task includes:

a candidate extraction task that extracts a plurality of candidate chords; and a first reflection task that reflects the chord tendency information retrieved by the chord tendency retrieval task in the respective candidate chords extracted by the candidate extraction task, and the chord detection task detects one of the candidate chords in which the chord tendency information has been reflected by the first reflection task.

7. The chord detection apparatus according to claim 6, wherein the candidate extraction task extracts candidate chords in accordance with a key of the musical piece.

8. The chord detection apparatus according to claim 7, wherein the key of the musical piece is input by the user or retrieved by analyzing the musical performance data retrieved by the musical performance data retrieval task.

9. The chord detection apparatus according to claim 8, wherein:

the candidate extraction task extracts only diatonic chords of the input or retrieved key as the candidate chords, and the candidate chords, which are all usable in the input or retrieved key, each have one or more notes included in the musical performance data.

10. The chord detection apparatus according to claim 6, wherein:

the chord detection task further includes a second reflection task that detects, using the musical performance data retrieved by the musical performance data retrieval task, respective degrees of importance of notes indicated by the musical performance data to each of the candidate chords extracted by the candidate extraction task, and reflects the detected degrees of importance in the candidate chords, and the chord detection task detects one chord from among the candidate chords in which the degrees of importance have been also reflected by the second reflection task.

11. The chord detection apparatus according to claim 6, wherein:

the chord detection task further includes a third reflection task that reflects degrees of priority of the candidate chords themselves extracted by the candidate extraction task in the respective candidate chords, and the chord detection tasks detects one chord from among the candidate chords in which the respective degrees of priority of the candidate chords have been also reflected by the third reflection task.

12. The chord detection apparatus according to claim 1, wherein the musical piece selecting task selects a title of the musical piece to be performed by the player.

13. The chord detection apparatus according to claim 12, wherein the musical piece information includes stored musical performance setting information.

14. A method of detecting a chord in a chord detecting apparatus having a processor, the method being executable by the processor and comprising:

a musical piece selecting step of selecting a musical piece to be performed by a player;

a musical piece information retrieval step of retrieving musical piece information corresponding to the selected musical piece;

a chord tendency information retrieval step of retrieving chord tendency information indicative of degrees of likelihood or unlikelihood of chords appearing in the selected musical piece based on the retrieved musical piece information;

a musical performance data retrieval step of retrieving musical performance data of musical performance performed by the player; and a chord detection step of detecting a chord based on the musical performance data retrieved by the musical performance data retrieval step and the chord tendency information retrieved by the chord tendency information retrieval step.

15. The method according to claim 14, wherein the musical piece selecting step selects a title of the musical piece to be performed by the player.

16. The method according to claim 15, wherein the musical piece information includes stored musical performance setting information.

17. A non-transitory computer-readable medium storing a computer program executable by a computer to detect a chord to execute a method comprising:

a musical piece selecting step of selecting a musical piece to be performed by a player;

a musical piece information retrieval step of retrieving musical piece information corresponding to the selected musical piece;

a chord tendency information retrieval step of retrieving chord tendency information indicative of degrees of likelihood or unlikelihood of chords appearing in the selected musical piece based on the retrieved musical piece information;

a musical performance data retrieval step of retrieving musical performance data of musical performance performed by the player; and a chord detection step of detecting a chord based on the musical performance data retrieved by the musical performance data retrieval step and the chord tendency information retrieved by the chord tendency information retrieval step.

18. The non-transitory computer-readable medium according to claim 17, wherein the musical piece selecting step selects a title of the musical piece to be performed by the player.

19. The non-transitory computer-readable medium according to claim 18, wherein the musical piece information includes stored musical performance setting information.

* * * * *